United States Patent [19]

Aotsuka et al.

[11] Patent Number: 4,751,175

[45] Date of Patent: Jun. 14, 1988

[54] HEAT DEVELOPABLE COLOR LIGHT-SENSITIVE MATERIAL

[75] Inventors: Yasuo Aotsuka; Takanori Hioki; Kiyohiko Yamamuro, all of Kanagawa, Japan

[73] Assignee: Fuji Photo Film Co., Ltd., Kanagawa, Japan

[21] Appl. No.: 22,494

[22] Filed: Mar. 6, 1987

Related U.S. Application Data

[63] Continuation of Ser. No. 711,862, Mar. 14, 1985, abandoned.

[30] Foreign Application Priority Data

Mar. 14, 1984 [JP] Japan ..... 59-48306

[51] Int. Cl.[4] ..... G03C 1/12; G03C 1/40

[52] U.S. Cl. ..... 430/560; 430/617; 430/619; 430/620; 430/570; 430/569; 430/203; 430/351

[58] Field of Search ..... 430/617, 619, 620, 592, 430/560, 570, 203, 351, 569

[56] References Cited

U.S. PATENT DOCUMENTS

| | | | |
|---|---|---|---|
| 4,225,666 | 9/1980 | Locker et al. | 430/592 |
| 4,476,220 | 10/1984 | Penfound | 430/619 |
| 4,500,626 | 2/1985 | Naito et al. | 430/619 |

*Primary Examiner*—Won H. Louie

*Attorney, Agent, or Firm*—Sughrue, Mion, Zinn, Macpeak & Seas

[57] ABSTRACT

A heat developable color light-sensitive material is disclosed, which comprises a support having provided thereon at least a light-sensitive silver halide emulsion, a binder, and a compound having a dye moiety within the molecule and which is capable of releasing, upon reduction of light-sensitive silver halide to silver at elevated temperatures, said dye moiety corresponding to or inversely corresponding to the reduction to form a dye different from said compound in terms of diffusibility, wherein said light-sensitive silver halide emulsion is prepared by forming silver halide grains in the presence of a sensitizing dye.

10 Claims, No Drawings

HEAT DEVELOPABLE COLOR LIGHT-SENSITIVE MATERIAL

This is a Continuation of application Ser. No. 711,862, filed Mar. 14, 1985, abandoned.

FIELD OF THE INVENTION

This invention relates to a heat developable color light-sensitive material with improved preservability, which comprises a dye providing substance capable of reacting with light-sensitive silver halide under heating in a state substantially containing no water to release a hydrophilic dye. Further, this invention relates to an improved preservability of heat developable color light-sensitive material which comprises a dye providing substance having a dye moiety within the molecule.

BACKGROUND OF THE INVENTION

Heretofore, photographic processes using silver halide have most widely been practiced, since they provide excellent sensitivity, gradation, and like photographic properties as compared with, for example, electrophotographic processes and diazo type photographic processes.

In recent years, techniques have been developed with silver halide light-sensitive materials which provide images simply and in a short time by employing dry processing which involves heating in place of the conventional wet processing which involves development in a developing solution. Heat developable light-sensitive materials are known in the art, and heat developable light-sensitive materials and the process thereof are described in, for example, *Shashin Kohgaku no Kiso,* pp. 553–555 (published by Corona Co., Ltd.), *Eizoh Johhoh,* April, 1978, p. 40, *Nebletts Handbook of Photography and Reprography,* 7th Ed. (Van Nostrand Reinhold Company), pp. 32–33, U.S. Pat. Nos. 3,152,904, 3,301,678, 3,392,020, 3,457,075, British Pat. Nos. 1,131,108, 1,167,777, and *Research Disclosure,* RD-17029, pp. 9–15 (June, 1978).

Many processes have been proposed for obtaining color images. As to a process of forming color image by binding an oxidation product of a developing agent with a coupler, U.S. Pat. No. 3,531,286 proposes p-phenylenediamine type reducing agents and phenolic or active methylene couplers, U.S. Pat. No. 3,761,270 proposes p-aminophenol type reducing agents, British Patent No. 802,519 and *Research Disclosure,* pp. 31 and 32 (September, 1975) propose sulfonamidophenol type reducing agents, and U.S. Pat. No. 4,021,240 proposes a combination of a sulfonamidophenol type reducing agent and a 4-equivalent coupler.

However, these processes have the disadvantage that, since an image of reduced silver and a color image are simultaneously formed in exposure areas upon heat development, the color image becomes turbid. As a means for removing this disadvantage, the silver image is removed by a liquid treatment, or the dye alone is transferred to a sheet having another layer, for example, image receiving layer. However, it is not easy to discriminate an unreacted material from a dye and only transfer the dye.

As to a process of forming positive color image according to a light-sensitive silver dye bleach process, useful dyes and bleaching processes are described in, for example, *Research Disclosure,* RD-14433, pp. 30–32 (April, 1976), ibid., RD-15227, pp. 14–15 (December, 1976), and U.S. Pat. No. 4,235,957.

In these processes, however, an additional step and an additional material are necessary for heating the materials with an activator sheet for accelerating bleaching of the dye superposed on them, and the resulting dye image suffers gradual reductive bleaching during a long term storage with the copresent free silver or the like.

Further, the above-described processes generally require a comparatively long developing time, and provide images having serious fog and low image density.

In order to overcome these disadvantages, there has been disclosed an image forming process based on heat development utilizing a compound having a dye moiety and being capable of releasing a mobile dye at elevated temperatures corresponding to or inversely corresponding to reduction of silver halide to siver (hereinafter, dye providing substance). For example, this process is disclosed in Published Unexamined European Pat. Nos. 76,492 and 79,056, Japanese Patent Application Nos. 28928/83 and 26008/83 (corresponding to European Pat. No. 120,306).

These systems have removed the above-described disadvantages to some extent but, when color sensitized silver halide is used therein, there arises deterioration of preservability of the light-sensitive materials. This may be attributed to the fact that, since the dye providing substance itself has a dye moiety, the dye properties of the dye moiety cause a mutual action, when used together with silver halide which has been color sensitized with a sensitizing dye, with the sensitizing dye adsorbed on the silver halide grains. Thus, the adsorbed sensitizing dye being desorbed from the surface of the silver halide grains during storage.

The above-described disadvantage is fatal with color light-sensitive materials.

SUMMARY OF THE INVENTION

An Object of the present invention is to improve the preservability of a light-sensitive material containing both a dye providing substance and a silver halide emulsion having been sensitized with a sensitizing dye, particularly to minimize change in the sensitivity during storage.

Another object of the present invention is to provide a heat developable light-sensitive material having improved preservability.

These and other objects of the present invention will become apparent from the following description thereof.

The above-described and other objects of the present invention are attained by a heat developable color light-sensitive material which comprises a support having provided thereon at least a light-sensitive silver halide emulsion, a binder, and a compound having a dye moiety within the molecule and which is capable of releasing, upon reduction of light-sensitive silver halide to silver at elevated temperatures, said dye moiety corresponding to or inversely corresponding to the reduction to form a dye different from said compound in terms of diffusibility, wherein said light-sensitive silver halide emulsion is prepared by forming silver halide grains in the presence of a sensitizing dye.

DETAILED DESCRIPTION OF THE INVENTION

As a result of forming silver halide grains in the presence of a sensitizing dye as described above, the sensitizing dye is adsorbed in a stable state on the silver halide grains to change the sensitivity of the silver halide in its intrinsic sensitivity region or to impart sensitivity in another region than the intrinsic sensitivity region.

As the sensitizing dye, methine dyes are usually used. Such methine dye includes cyanine dyes, merocyanine dyes, complex cyanine dyes, complex merocyanine dyes holopolar cyanine dyes, hemicyanine dyes, styryl dyes and hemioxonol dyes. Particularly useful dyes are cyanine dyes, merocyanine dyes and complex merocyanine dyes. These dyes can contain, as a basic heterocyclic nucleus, any of the nuclei which are usually employed in cyanine dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, and the like; nuclei as described above condensed with an alicyclic hydrocarbon ring; and nuclei as described above condensed with an aromatic hydrocarbon ring such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus. The carbon atoms of the above-described nuclei may be substituted.

The merocyanine dyes or complex merocyanine dyes can contain, as a nucleus having a ketomethylene structure, a 5- or 6-membered heterocyclic nucleus such as a pyrazolin-5-one nucleus, a thiohydantoin nucleus, a 2-thiooxazolidine-2,4-dione nucleus, a thiazolidine-2,4-dione nucleus, a rhodanine nucleus or a thiobarbituric acid nucleus.

In the present invention, the compounds having a dye moiety within the molecule and which are capable of releasing, upon reduction of light-sensitive silver halide to silver at elevated temperatures, said dye moiety corresponding to or inversely corresponding to the reduction to form a dye different from said compound in diffusibility (hereinafter, dye providing substance) are preferably represented by the following general formula (CI):

$$(\text{Dye—X})_q\text{—Y} \qquad \text{(CI)}$$

In the above general formula, Dye represents a dye moiety which, when released from the molecule, has a diffusibility different from that of $(\text{Dye—X})_q$—Y and which preferably has a hydrophilic group. Usable dyes include azo dyes, azomethine dyes, anthraquinone dyes, naphthoquinone dyes, styryl dyes, nitro dyes, quinoline dyes, carbonyl dyes, phthalocyanine dyes, etc. Typical examples thereof are illustrated below. Additionally, these dyes may be used in a temporarily short-shifted form which can be restored to the original form upon development processing.

Specifically, dyes described in Published Unexamined European Pat. No. 76,492 can be utilized.

q represents 1 or 2 and, when q=2, Dye—X may be the same or different from each other.

X represents a mere bond or a linking group such as —NR— (wherein R represents hydrogen, an alkyl group or a substituted alkyl group), —$SO_2$—, —CO—, an alkylene group, a substituted alkylene group, a phenylene group, a substituted phenylene group, a naphthylene group, a substituted naphthylene group, —O—, —SO— or a group formed by the combination of two or more of them.

Y represents a group which releases Dye corresponding to or inversely corresponding to light-sensitive silver salt imagewise having a latent image to cause a difference in diffusibility between the released dye and the compound represented by $(\text{Dye—X})_q$—Y.

Preferably, the compound represented by $(\text{Dye—X})_q$—Y itself is diffusion resistant and releases a mobile Dye. The released Dye is preferably allowed to transfer to a dye fixing layer and is fixed there to thereby form a color image in the dye fixing layer.

Specific examples of sensitizing dyes useful in the present invention include those represented by the following general formulae (A) to (H), (J) to (U), (W) and (Y):

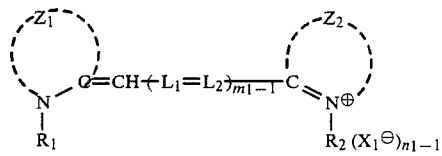

(A)

In the above-described general formula, $Z_1$ and $Z_2$ each represents atoms necessary for completing a heterocyclic nucleus usually used in cyanine dyes, particularly a thiazole nucleus, a thiazoline nucleus, a benzothiazole nucleus, a naphthothiazole nucleus, an oxazole nucleus, a benzoxazole nucleus, a naphthoxazole nucleus, a tetrazole nucleus, a pyridine nucleus, a quinoline nucleus, an imidazoline nucleus, an imidazole nucleus, a benzimidazole nucleus, a naphthoimidazole nucleus, a selenazoline nucleus, a selenazole nucleus, a benzoselenazole nucleus, a naphthoselenazole nucleus, or an indolenine nucleus.

$L_1$ and $L_2$ each represents a methine group or a substituted methine group.

$R_1$ and $R_2$ each represents an alkyl group containing 1 to 5 carbon atoms; a substituted alkyl group containing a carboxy group; a substituted alkyl group containing a sulfo group such as a γ-sulfopropyl group, a δ-sulfobutyl group, a 2-(3-sulfopropoxy)ethyl group, a 2-[2-(3-sulfopropoxy)ethoxy]ethyl group, a 2-hydroxysulfopropyl group; an allyl group or a substituted alkyl group usually employed as an N-substituent in cyanine dyes.

$m_1$ represents 1, 2 or 3.

$X_1\ominus$ represents an acid anion group commonly used in cyanine dyes such as an iodide ion, a bromide ion, a p-toluenesulfonate ion, a perchlorate ion or the like.

$n_1$ represents 1 or 2 and, when the dye has a betaine structure, $n_1$ represents 1.

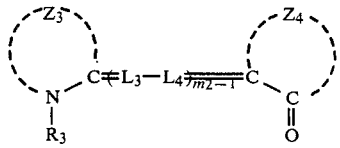

(B)

In the above general formula, $Z_3$ represents a heterocyclic nucleus usually used in cyanine dyes as defined with respect to the general formula (A), $Z_4$ represents atoms necessary for forming a ketohetero nucleus usually used in merocyanine dyes, such as a rhodanine nucleus, a thiohydantoin nucleus, a hydroxyindole nucleus, a 2-thiooxazolidinedione nucleus or a 1,3-indanedione nucleus, $L_3$ and $L_4$ are the same as defined for $L_1$ and $L_2$, $R_3$ is the same as defined for $R_1$ or $R_2$, and $m_2$ represents 1, 2, 3 or 4.

(C)

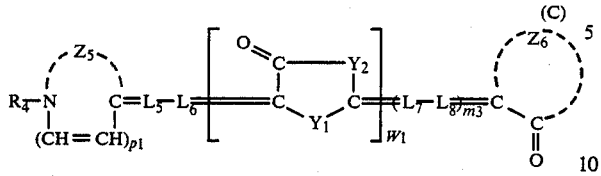

In the above-described general formula, $Z_5$ represents atoms necessary for completing a 4-quinoline nucleus, a 2-quinoline nucleus, a benzothiazole nucleus, a benzoxazole nucleus, a naphthothiazole nucleus, a naphthoselenazole nucleus, a naphthoxazole nucleus, a benzoselenazole nucleus, or an indolenine nucleus, $p_1$ represents 0 or 1, $R_4$ is the same as defined for $R_1$ or $R_2$, $L_5$ and $L_6$ are the same as defined for $L_3$ or $L_4$, $m_3$ represents 0, 1 or 2, $L_7$ and $L_8$ are the same as defined for $L_1$ or $L_2$, $Z_6$ is the same as defined for $Z_4$, $Y_1$ and selenium atom or $=N-R_5$ (wherein $R_5$ represents an alkyl group containing up to 8 carbon atoms such as a methyl group, an ethyl group or a propyl group, or an allyl group), with at least one of them being $=N-R_5$, and $W_1$ represents 1 or 2.

(D)

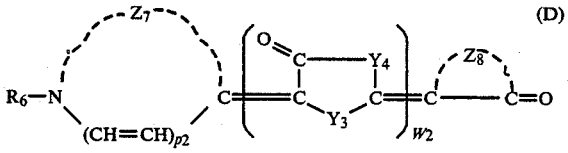

In the above general formula, $Z_7$ is the same as defined for $Z_5$, $Z_8$ is the same as defined for $Z_6$, $R_6$ is the same as defined for $R_1$ or $R_2$, $p_2$ is the same as defined for $p_1$, $Y_3$ and $Y_4$ are the same as defined for $Y_1$ and $Y_2$, and $W_2$ is the same as defined for $W_1$.

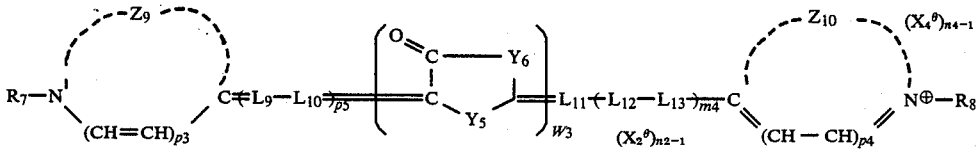

In the above general formula, $R_7$ and $R_8$ are the same as defined for $R_1$, $Z_9$ and $Z_{10}$ are the same as defined for $Z_5$, $p_3$ and $p_4$ are the same as defined for $p_1$, $L_9$ to $L_{13}$ are the same as defined for $L_1$, $X_2$ is the same as defined for $X_1$, $n_2$ is the same as defined for $n_1$, $Y_5$ and $Y_6$ are the same as defined for $Y_1$, $p_5$ and $m_4$ each represents 0 or 1, and $W_3$ is the same as defined for $W_1$.

(F)

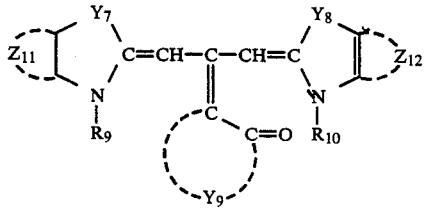

In the above general formula, $Z_{11}$ and $Z_{12}$ each represents atoms necessary for completing an unsubstituted or substituted benzene ring or a naphthalene ring, $R_9$ and $R_{10}$ are the same as defined for $R_1$, $Y_7$ and $Y_8$ each represents an oxygen atom, a sulfur atom, a selenium atom,

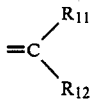

(wherein $R_{11}$ and $R_{12}$ each represents a methyl group or an ethyl group), $=N-R_{13}$ (wherein $R_{13}$ represents an alkyl group, a substituted alkyl group usually employed as an N-substituent in cyanine dyes, or an allyl group) or $-CH=CH-$, and $Y_9$ represents atoms necessary for forming a 5- or 6-membered hetero ring.

(G)

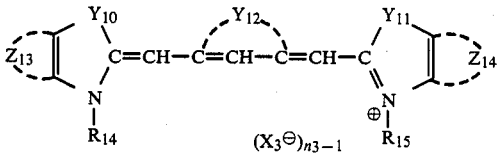

In the above general formula, $Z_{13}$ and $Z_{14}$ are the same as defined for $Z_{11}$, $R_{14}$ and $R_{15}$ are the same as defined for $R_1$, $Y_{10}$ and $Y_{11}$ are the same as defined for $Y_7$, $Y_{12}$ represents atoms necessary for forming a 5- or 6-membered carbon ring, $X_3$ is the same as defined for $X_1$, and $n_3$ is the same as defined for $n_1$.

(H)

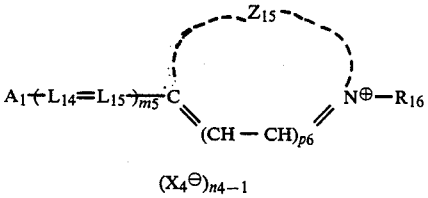

(J)

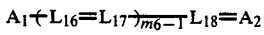

(E)

In the above general formulae, $X_4$ and $n_4$ are the same as defined for $X_1$ and $n_1$, respectively, $p_6$ represents 0 or 1, $m_5$ and $m_6$ each represents 1 or 2, $L_{14}$ to $L_{18}$ are the same as defined for $L_1$, and $Z_{15}$ is the same as defined for $Z_1$.

Preferable examples of $A_1$ are illustrated below.

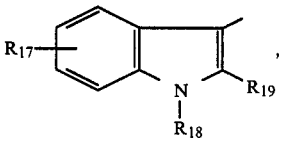

-continued

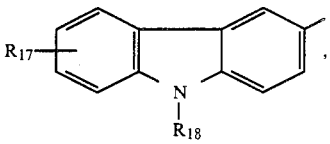

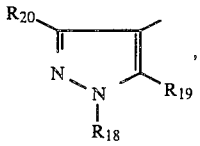

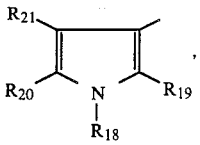

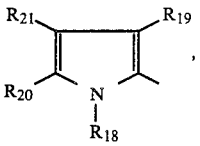

or

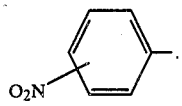

Preferable examples of $A_2$ are illustrated below:

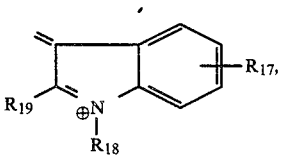

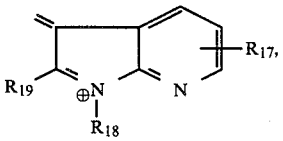

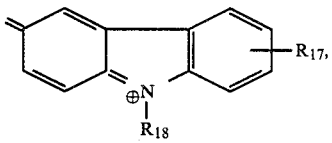

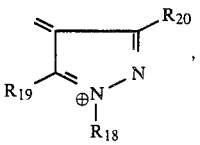

-continued

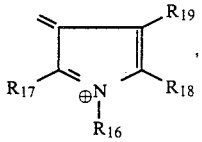

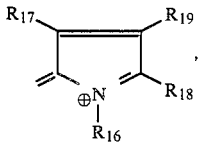

or

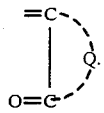

$R_{16}$ and $R_{18}$ each represents hydrogen, an alkyl group, a substituted alkyl group or an aryl group, $R_{17}$ represents a halogen atom, a nitro group, a lower alkyl group, an alkoxy group, an alkoxycarbonyl group, an alkylsulfonyl group or an arylsulfonyl group, $R_{19}$, $R_{20}$ and $R_{21}$ each represents hydrogen, a halogen atom, an alkyl group, a cycloalkyl group, an aryl group, a pyridyl group, a carboxy group or an alkoxycarbonyl group, and Q represents atoms necessary for completing a 5- or 6-membered heterocyclic nucleus such as rhodanine, 2-thiooxazolidinedione, 2-thiohydantoin, barbituric acid or the like.

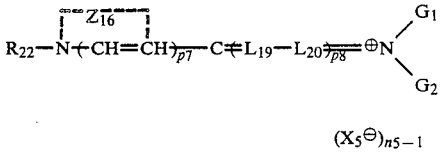

(K)

In the above general formula, $R_{22}$ is the same as defined for $R_1$, $Z_{16}$ is the same as defined for $Z_1$, $L_{19}$ and $L_{20}$ are the same as defined for $L_1$, $p_7$ represents 0 or 1, $p_8$ represents 1, 2 or 3, $G_1$ and $G_2$, which may be the same or different, are the same as defined for $R_1$, or, when taken together, $G_1$ and $G_2$ represent atoms necessary for forming a cyclic secondary amine (e.g., pyrrolidone, 3-pyrroline, piperidinene, piperazine, or morpholine), $X_5$ is the same as defined for $X_1$, and $n_5$ is the same as defined for $n_1$.

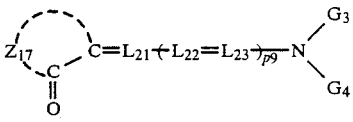

(L)

In the above general formula, $Z_{17}$ is the same as defined for $Z_4$, $L_{21}$, $L_{22}$ and $L_{23}$ are the same as defined for $L_1$, $G_3$ and $G_4$ are the same as defined for $G_1$, and $p_9$ represents 0, 1, 2 or 3.

Dyes particularly useful for imparting infrared light sensitivity are those which are represented by the following general formulae (M) to (U), (W) and (Y):

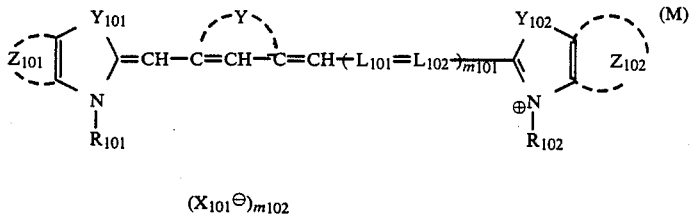

(M)

In the above general formula, $R_{101}$ and $R_{102}$, which may be the same or different, each represents an alkyl group (containing up to 6 carbon atoms).

In the general formula (M), $Y_{101}$ and $Y_{102}$ each represents an oxygen atom, a sulfur atom, a selenium atom,

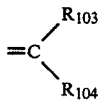

(wherein $R_{103}$ and $R_{104}$ each represents a methyl group or an ethyl group), =N—$R_{105}$ (wherein $R_{105}$ represents an unsubstituted or substituted alkyl group containing up to 5 carbon atoms or an allyl group) or —CH=CH—.

In the general formula (M), $Z_{101}$ and $Z_{102}$ each represents atoms necessary for forming an unsubstituted or substituted benzene or naphthyl ring.

As the nitrogen-containing ring formed by a $Y_{101}$-containing ring and $Z_{101}$ or by a $Y_{102}$-containing ring and $Z_{102}$, there are illustrated, for example, thiazole nucleus systems (e.g., benzothiazole, 4-chlorobenzothiazole, 4-methylbenzothiazole, 5-phenylbenzothiazole, 5-methoxybenzothiazole, 5-carboxybenzothiazole, 5-ethoxycarbonylbenzothiazole, tetrahydrobenzothiazole, naphtho[2,1-d]thiazole, 5-methoxynaphtho[1,2-d]thiazole, etc.), selenazole nucleus systems (e.g., benzoselenazole, 5-chlorobenzoselenazole, 5-methoxybenzoselenazole, 5-methylbenzoselenazole, 5-hydroxybenzoselenazole, naphtho[2,1-d]selenazole, naphtho[1,2-d]selenazole, etc.), oxazole nucleus systems (e.g., benzoxazole, 5-chlorobenzoxazole, 5-methylbenzoxazole, 5-phenylbenzoxazole, 5-methoxybenzoxazole, 5-carboxybenzoxazole, 5-hydroxybenzoxazole, naphtho[2,1-d]oxazole, etc.), quinoline nucleus systems (e.g., 2-quinoline, 3-methyl-2-quinoline, 8-fluoro-2-quinoline, 6-methoxy-2-quinoline, 6-hydroxy-2-quinoline, etc.), 3,3-dialkylindolenine nucleus systems (e.g., 3,3-dimethylindolenine, 3,3-dimethyl-5-cyanoindolenine, 3,3-dimethyl-5-methoxyindolenine, etc.), imidazole nucleus systems (e.g., 1-ethylbenzimidazole, 1-methyl-5-chlorobenzimidazole, 1-methyl-5-cyanobenzimidazole, 1-phenyl-5,6-dichlorobenzimidazole, 1-methyl-5-trifluoromethylbenzimidazole, 1-ethylnaphtho[1,2-d]imidazole, etc.), etc.

In the general formula (M), Y represents atoms necessary for forming a 5- or 6-membered carbon ring or, when no ring is formed, Y merely represents a methine chain.

In the general formula (M), $m_{101}$ represents 1 or 2;

$X_{101}$ represents an acid residue;

$m_{102}$ represents 0 or 1 and, when the dye has a betaine structure, $m_{102}$ represents 0; and $L_{101}$ and $L_{102}$ each represents a methine group or a substituted methine group.

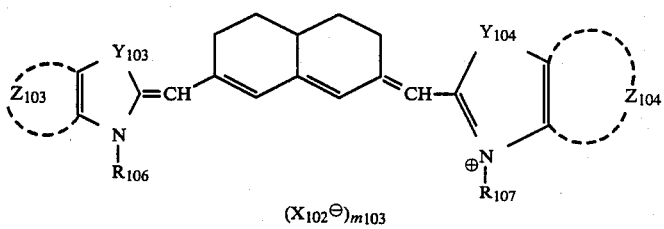

(N)

In the above general formula, $Y_{103}$ and $Y_{104}$ are the same as defined for $Y_{101}$ in general formula (M);

$R_{106}$ and $R_{107}$ are the same as defined for $R_{101}$ in general formula (M);

$Z_{103}$ and $Z_{104}$ are the same as defined for $Z_{101}$ in general formula (M);

$X_{102}$ is the same as defined for $X_{101}$ in general formula (M);

and $m_{103}$ is the same as defined for $m_{102}$ in the general formula (M).

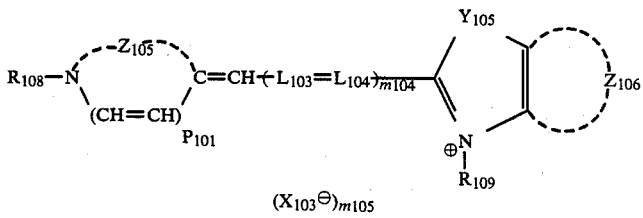

(O)

In the above general formula, $Z_{105}$ represents atoms necessary for completing a 4-quinoline nucleus or a 2-quinoline nucleus;

$Z_{106}$ is the same as defined for $Z_{101}$ in the general formula (M);

$p_{101}$ represents 0 or 1;

$m_{104}$ represents 2 or 3;

$Y_{105}$ is the same as defined for $Y_{101}$ in the general formula (M);

$R_{108}$ and $R_{109}$ are the same as defined for $R_{101}$ in the general formula (M);

$X_{103}$ is the same as defined for $X_{101}$ in the general formula (M);

$m_{105}$ is the same as defined for $m_{102}$ in the general formula (M); and $L_{103}$ and $L_{104}$ are the same as defined for $L_{101}$ in the general formula (M).

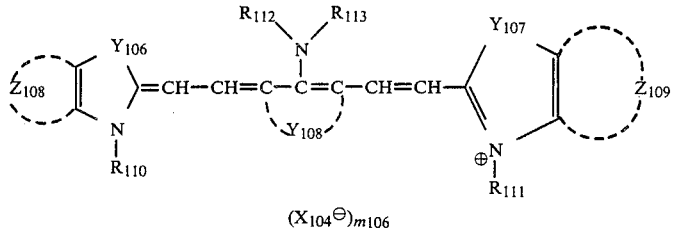

(P)

In the above formula, $Z_{108}$ and $Z_{109}$ are the same as defined for $Z_{101}$ in the general formula (M);

$R_{110}$ and $R_{111}$ are the same as defined for $R_{101}$ in the general formula (M);

$Y_{108}$ is the same as defined for Y in the general formula (M);

$X_{104}$ is the same as defined for $X_{101}$ in the general formula (M);

$m_{106}$ is the same as defined for $m_{102}$ in the general formula (M); and $Y_{106}$ and $Y_{107}$ are the same as defined for $Y_{101}$ in the general formula (M).

$R_{112}$ and $R_{113}$ each represents an alkyl group containing 1 to 4 carbon atoms or a phenyl group, or $R_{112}$ and $R_{113}$ taken together with the nitrogen atom to which they are bonded represent atoms necessary for forming a 5- or 6-membered hetero ring.

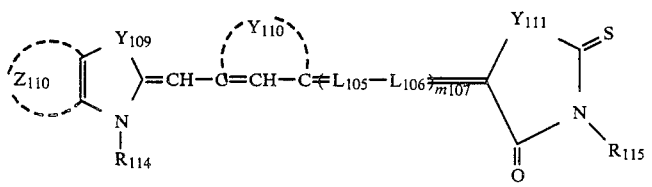

In the above formula, $Z_{110}$ is the same as defined for $Z_{101}$ in the general formula (M);

$Y_{109}$ is the same as defined for $Y_{101}$ in the general formula (M);

$Y_{111}$ represents an oxygen atom, a sulfur atom, a selenium atom or $=N-R_{116}$ (wherein $R_{116}$ is the same as defined for $R_{105}$ in the general formula (M));

$R_{114}$ is the same as defined for $R_{101}$ in the general formula (M);

$R_{115}$ is the same as defined for $R_{101}$ in the general formula (M) or represents a phenyl group, a pyridyl group or a substituted phenyl group;

$Y_{110}$ is the same as defined for Y in the general formula (M);

$m_{107}$ is the same as defined for $m_{101}$ in the general formula (M); and $L_{105}$ and $L_{106}$ are the same as defined for $L_{101}$ in the general formula (M).

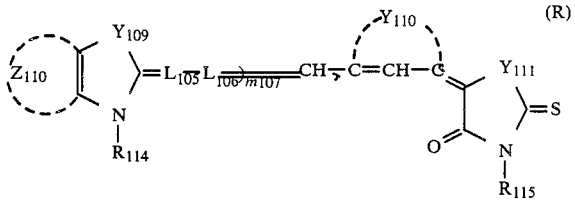

(R)

In the above general formula, $Z_{110}$, $Y_{109}$, $Y_{110}$, $Y_{111}$, $R_{114}$, $R_{115}$, $L_{105}$, $L_{106}$ and $m_{107}$ are the same as defined with respect to the general formula (Q).

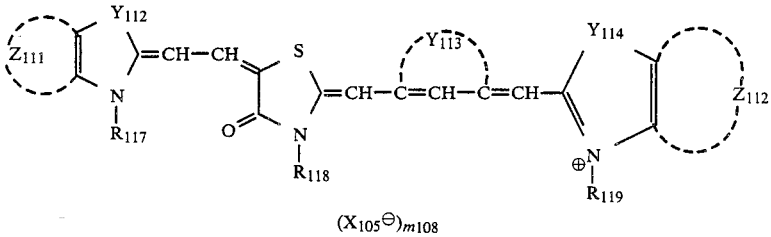

(S)

In the above general formula, $Z_{111}$ and $Z_{112}$ are the same as defined for $Z_{101}$ in the general formula (M);

$Y_{112}$ and $Y_{114}$ are the same as defined for $Y_{101}$ in the general formula (M);

$R_{117}$ and $R_{119}$ are the same as defined for $R_{101}$ in the general formula (M);

$R_{118}$ is the same as defined for $R_{105}$ in the general formula (M);

$Y_{113}$ is the same as defined for Y in the general formula (M);

$X_{105}$ is the same as defined for $X_{101}$ in the general formula (M); and $m_{108}$ is the same as defined for $m_{102}$ in the general formula (M).

$Z_{116}$ is the same as defined for $Z_{101}$ in the general formula (M);

$R_{123}$ and $R_{124}$ are the same as defined for $R_{101}$ in the general formula (M);

q represents 0 or 1;

$X_{107}$ is the same as defined for $X_{101}$ in the general formula (M);

$m_{110}$ is the same as defined for $m_{102}$ in the general formula (M); and $R_{125}$ is the same as defined for $R_{118}$ in the general formula (S).

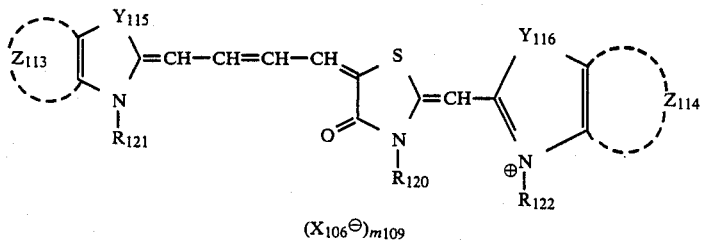

(T)

In the above general formula, $Z_{113}$ and $Z_{114}$ are the same as defined for $Z_{101}$ in the general formula (M);

$Y_{115}$ and $Y_{116}$ are the same as defined for $Y_{101}$ in the general formula (M);

$R_{121}$ and $R_{122}$ are the same as defined for $R_{101}$ in the general formula (M);

$X_{106}$ is the same as defined for $X_{101}$;

$m_{109}$ is the same as defined for $m_{102}$ in the general formula (M); and $R_{120}$ is the same as defined for $R_{118}$ in the general formula (S).

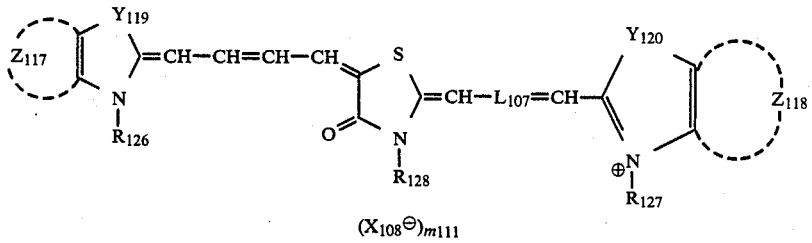

(W)

In the above general formula, $Z_{117}$ and $Z_{118}$ are the same as defined for $Z_{101}$ in the general formula (M);

$Y_{119}$ and $Y_{120}$ are the same as defined for $Y_{101}$ in the general formula (M);

$R_{126}$ and $R_{127}$ are the same as defined for $R_{101}$ in the general formula (M);

$X_{108}$ is the same as defined for $X_{101}$ in the general formula (M);

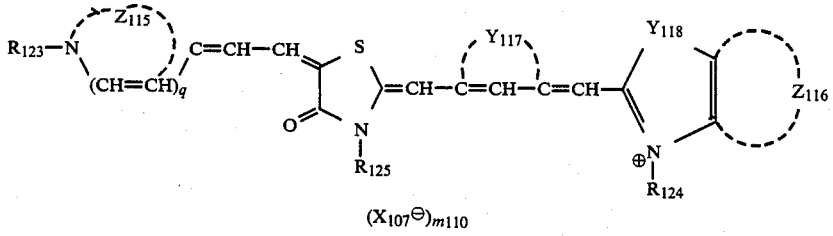

(U)

In the above general formula, $Y_{117}$ is the same as defined for Y in the general formula (M);

$Y_{118}$ is the same as defined for $Y_{101}$ in the general formula (M);

$Z_{115}$ is the same as defined for $Z_{105}$ in the general formula (O);

$m_{111}$ is the same as defined for $m_{102}$ in the general formula (M);

$L_{107}$ is the same as defined for $L_{101}$ and $L_{102}$ in the general formula (M); and $R_{128}$ is the same as defined for $R_{118}$ in the general formula (S).

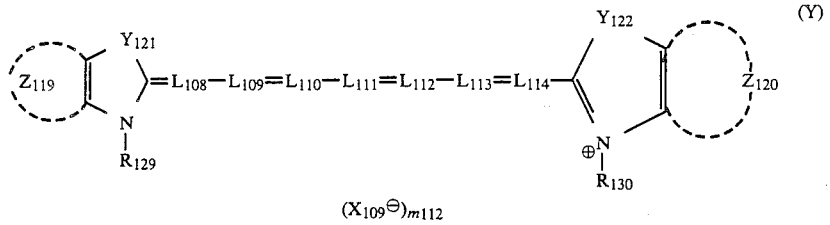

(Y)

In the above general formula, $Z_{119}$ and $Z_{120}$ are the same as defined for $Z_{101}$ in the general formula (M);

$Y_{121}$ and $Y_{122}$ are the same as defined for $Y_{101}$ in the general formula (M);

$R_{129}$ and $R_{130}$ are the same as defined for $R_{101}$ in the general formula (M);

$L_{108}$, $L_{109}$, $L_{110}$, $L_{111}$, $L_{112}$, $L_{113}$, and $L_{114}$ are the same as defined for $L_{101}$ in the general formula (M);

$X_{109}$ is the same as defined for $X_{101}$; and $m_{112}$ is the same as defined for $m_{102}$.

According to the present invention, the above-described sensitizing dye is present in a process of formation of dispersion of silver halide grains or a process of physical ripening of silver halide grains. In the present invention, the aforementioned sensitizing dyes may be allowed to be present in the reaction system between a soluble silver salt (e.g., silver nitrate) and a halide (e.g., potassium bromide) before silver halide grains are formed according to the techniques described in U.S. Pat. No. 4,183,756, or may be allowed to be present in the above-described reaction system after formation of silver halide grain nuclei and before completion of silver halide grain formation (i.e., during the physical ripening) according to U.S. Pat. No. 4,225,666. Further, the sensitizing dye may be allowed to be present in the reaction solution simultaneously with the formation of silver halide grains, i.e., simultaneously with the mixing of said silver salt with said halide. This manner is particularly preferable in that light-sensitive materials containing the thus prepared emulsion have better preservability at elevated temperatures and show better gradation.

In every manner described above of adding the sensitizing dye, the dye may be added at once or in several portions. Further, the dye may be added as a mixture with the soluble silver salt and/or the halide.

The dyes may be used alone or in combination of two or more (as a mixture or separately at the same time or in sequence). In the case of using two or more dyes, a supersensitizing dye or dyes may be included.

The dye may be added to the surface of the solution or into the solution, and stirring may be effected in any of known manners.

The sensitizing dye may be added as a solution in a water-miscible organic solvent (e.g., methanol, ethanol, propanol, fluorinated alcohol, methyl cellosolve, dimethylformamide or acetone) or water (alkaline or acidic), or a mixture of two or more of them. Also, it may be added as a dispersion in a water/gelatin dispersion system or as a freeze-dried powder. Further, it may be added as a powder or solution prepared by dispersing with the aid of a surfactant.

The sensitizing dye is suitably used in an amount of 0.001 g to 20 g, preferably 0.01 g to 2 g, per 100 g of silver.

The concentration of the sensitizing dye in a reaction solution wherein formation of silver halide grains proceeds is suitably up to 1 wt%, preferably up to 0.1 wt%.

During chemical ripening of the silver halide emulsion prepared according to the present invention or during other steps before coating the emulsion, the same or different sensitizing dye or a supersensitizing dye may be additionally added to the system.

As the supersensitizing agents, there may be included aminostyryl compounds substituted by a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc. Combinations described in U.S. Pat. Nos. 3,615,613, 3,615,641, 3,617,295, and 3,635,721 are particularly useful.

Silver halide to be used in the present invention include silver chloride, silver chlorobromide, silver chloroiodide, silver bromide, silver bromoiodide, siler chloroiodobromide, silver iodide, etc.

These siler halides may be obtained as follows. With silver iodobromide, for example, a silver nitrate solution is added to a potassium bromide solution to form silver bromide grains, followed by adding potassium iodide.

As processes for forming silver halide grains to be used in the present invention, known single jet process and double jet process may be employed. With the latter processes, so-called double jet process may also be employed in which the pAg of the reaction solution is kept constant. In addition, a combination of these processes is also employable. In every process described above, the addition may be effected in one step or multi-steps known in the art, and the rate of the addition may be constant or may be changed stepwise or continuously (for example, by changing the adding rate of the solution of the soluble silver salt and/or the solution of halide, with keeping the concentrations thereof constant, or by changing the concentration of the soluble silver salt and/or halide, with keeping the solution-adding rate constant, or by the combination thereof). Stirring of the reaction solution may be effected by any known method. The temperature and pH of the reaction solution during formation of silver halide grains may be at any level but, with some sensitizing dyes to be allowed to be present, they are desirably selected so that destruction of the dye does not take place.

In forming silver halide grains to be used in the present invention, known silver halide solvents or crystal habit controlling agents (e.g., ammonia, rhodan, organic thioether derivatives, thiocarbamic acid ester derivatives, dithiocarbamic acid ester derivatives, etc.) may be used alone or in combination.

Silver halide grains formed in the presence of the sensitizing dye according to the above-described various processes are in a regular crystal form such as cubic or octahedral form, in an irregular crystal form such as spherical or tabular form, or in a mixed form thereof. With each grain, the effects of the present invention are obtained.

The effects obtained by the present invention may be obtained with silver halide grains having an inner portion and a surface layer different from, or the same as, each other in phase composition.

During formation or physical ripening of siler halide grains, cadmium salts, zinc salts, lead salts, thallium salts, iridium salts or the complex salts thereof (e.g., iridium chloride (III) or (IV), ammonium hexachloroiridate, etc.) rhodium salts or the complex salts thereof (rhodium chloride, etc.), iron salts or the complex salts thereof, etc., may be allowed to coexist.

In the process of the present invention for preparing silver halide emulsion, gelatin is advantageously used as a binder. However, other hydrophilic colloids can be used as well. For example, proteins (e.g., gelatin derivatives, graft polymers between gelatin and other high polymer, albumin, casein, etc.; cellulose derivatives such as hydroxyethyl cellulose, carboxymethyl cellulose, cellulose sulfate, etc.; sugar derivatives such as sodium alginate, starch derivative, etc.; and various synthetic hydrophilic substances such as homopolymers or copolymers (e.g., polyvinyl alcohol, polyvinyl alcohol partial acetal, poly-N-vinyl pyrrolidone, polyacrylic acid, polymethacrylic acid, polyacrylamide, polyvinyl imidazole, polyvinyl pyrazole, etc.) can be used.

As gelatin, acid-processed gelatin or enzyme-processed gelatin as described in *Bull. Soc. Sci. Phot. Japan,* No. 16, p. 30 (1966) may be used as well as lime-processed gelatin, and a gelatin hydrolyzate or an enzyme-decomposed product can be used.

Silver halide grains to be used in the present invention preferably have an average grain size of 0.001 μm to 10 μm, with 0.001 μm to 5 μm being more preferable.

The surface and/or inner portion of silver halide grains to be used in the present invention may be chemically sensitized. Chemical sensitization can be conducted according to, for example, the process described in H. Frieser, *Die Grundlagen der Photographischen Prozesse mit Silberhalogeniden* (Akademische Verlagsgesellschaft, 1968), pp. 675–724.

That is, a sulfur sensitization process using active gelatin or a sulfur-containing compound capable of reacting with silver (e.g., thiosulfates, thioureas, mercapto compounds, rhodanines, etc.) and a sensitization process using a selenium or tellurium compound; reduction sensitization process using a reductive substance (e.g., stannous salts, amines, hydrazine derivatives, formamidinesulfinic acid, silane compounds, etc.); and a noble metal sensitization process using compounds of noble metals (e.g., gold complex salts, complex salts of Group VIII metals such as Pt, Ir and Pd) can be used alone or in combination.

As to specific examples of these processes, the sulfur sensitization process is described in U.S. Pat. Nos. 1,574,944, 2,410,689, 2,287,947, 2,728,668, 3,656,955, etc., the reduction sensitization process in U.S. Pat. Nos. 2,983,609, 2,419,974, 4,054,458, etc.; and noble metal sensitization process in U.S. Pat. Nos. 2,399,083 and 2,448,060, British Pat. No. 618,061, etc.

Techniques described in Japanese Patent Publication No. 34213/77 can be utilized for conducting surface chemical sensitization of internal latent image silver halide grains, and core/shell type such emulsions may be subjected to the surface chemical sensitization in the presence of a specific polymer described in Japanese Patent Application (OPI) No. 136641/82 (the term "OPI" as used herein refers to a "published unexamined Japanese patent application").

In the present invention, the light-sensitive silver halide is suitably coated in a silver amount of 1 mg to 100 g/m$^2$, more preferably 10 mg to 50 g/m$^2$.

Organic silver salts may be allowed to copresent in the light-sensitive material of the present invention. Examples of such organic silver salt oxidizing agent are described in Japanese Patent Application (OPI) No. 58543/83, and include, for example, the following ones.

Firstly, there are illustrated silver salts of organic compounds having a carboxy group. Typical examples thereof include silver salts of aliphatic and aromatic carboxylic acids.

Other examples include silver salts of compounds having a mercapto group or a thione group and the derivatives thereof.

In addition, there are silver salts of compounds containing an amino group, such as silver salts of benzotriazole and derivatives thereof described in Japanese Patent Publication Nos. 30270/69 and 18416/70, silver salt of benzotriazole, silver salts of alkyl-substituted benzotriazoles (e.g., silver salt of methylbenzotriazole, etc.), silver salts of halogen-substituted benzotriazoles (e.g., silver salt of 5-chlorobenzotriazole), silver salts of carboimidobenzotriazoles (e.g., silver salt of butylcarboimidobenzotriazole), silver salts of 1,2,4-triazole and 1-H-tetrazole described in U.S. Pat. No. 4,220,709, silver salt of carbazole, silver salt of saccharin, silver salt of imidazole or imidazole derivative, etc.

Silver salts described in *Research Disclosure,* No. 170, 17029 and organic metal salts such as copper stearate are also usable in the present invention as the organic metal salt oxidizing agents.

Processes for preparing these silver halides and organic silver salts and methods for mixing them are described in *Research Disclosure,* No. 170, 17029, Japanese Patent Application (OPI) Nos. 32928/75, 42529/76, 13224/74, 17216/75 and U.S. Pat. No. 3,700,458.

In using the light-sensitive silver halide and the organic silver salt in combination, they are suitably used in a total silver amount of 1 mg to 100 g/m$^2$, more preferably 10 mg to 50 g/m$^2$.

Y in the general formula (CI) is described in detail below.

Y is to be selected so that the compound represented by the formula of (CI) becomes a dye providing nondiffusible substance which is oxidized, as a result of development processing, to undergo self cleavage and give a diffusible dye.

Examples of Y effective for this type compounds are N-substituted sulfamoyl groups. For example, those groups which are represented by the following general formula (CII) may be illustrated as Y:

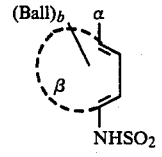

(CII)

wherein

β represents non-metallic atoms necessary for forming a benzene ring, which may optionally be fused with a carbon ring or a hetero ring to form, for example, a naphthalene ring, a quinoline ring, a 5,6,7,8-tetrahydronaphthalene ring, a chroman ring or the like.

$\alpha$ represents a group of $-OG^{11}$ or $-NHG^{12}$ (wherein $G^{11}$ represents hydrogen or a group which forms a hydroxy group upon being hydrolyzed, and $G^{12}$ represents hydrogen, an alkyl group containing 1 to 22 carbon atoms or a hydrolyzable group), Ball represents a ballast group, and b represents an integer of 0, 1 or 2.

Specific examples of this type of Y are described in Japanese Patent Application (OPI) Nos. 33826/73 and 50736/78.

Other examples of Y suited for this type of compound are those represented by the following general formula (CIII):

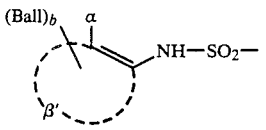

(CIII)

wherein Ball, $\alpha$, and b are the same as defined with (CII), $\beta'$ represents atoms necessary for forming a carbon ring (e.g., a benzene ring which may be fused with another carbon ring or a hetero ring to form a naphthalene ring, quinoline ring, 5,6,7,8-tetrahydronaphthalene ring, chroman ring or the like. Specific examples of this type of Y are described in Japanese Patent Application (OPI) Nos. 113624/76, 12642/81, 16130/81, 4043/82 and 650/82, and U.S. Pat. No. 4,053,312.

Further examples of Y suited for this type of compound are those represented by the following formula (CIV):

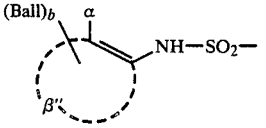

(CIV)

wherein Ball, $\alpha$, and b are the same as defined with the formula (CII), and $\beta''$ represents atoms necessary for forming a hetero ring such as a pyrazole ring, a pyridine ring or the like, said hetero ring being optionally bound to a carbon ring or a hetero ring. Specific examples of this type of Y are described in Japanese Patent Application (OPI) No. 104343/76.

Still further examples of Y suited for this type of compound are those represented by the following formula (CV):

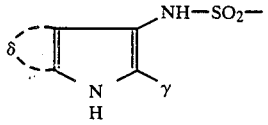

(CV)

wherein $\gamma$ preferably represent hydrogen, a substituted or unsubstituted alkyl, aryl or heterocyclic group, or $-CO-G^{21}$; $G^{21}$ represents $-OG^{22}$, $-SG^{22}$ or

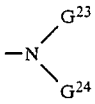

(wherein $G^{22}$ represents hydrogen, an alkyl group, a cycloalkyl group or an aryl group, $G^{23}$ is the same as defined for said $G^{22}$, or $G^{23}$ represents an acyl group derived from an aliphatic or aromatic carboxylic or sulfonic acid, and $G^{24}$ represents hydrogen or an unsubstituted or substituted alkyl group); and $\delta$ represents a residue necessary for completing a fused benzene ring.

Specific examples of this type of Y are described in Japanese Patent Application (OPI) Nos. 104343/76, 46730/78, 130122/79 and 85055/82.

Still further examples of Y suited for this type of compound are those represented by the formula (CVI):

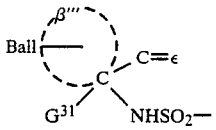

(CVI)

wherein Ball is the same as defined with the formula (CII); $\epsilon$ represents an oxygen atom or $=NG^{32}$ (wherein $G^{32}$ represents hydroxy or an optionally substituted amino group) (examples of $H_2N-G^{32}$ to be used for forming the group of $=NG^{32}$ including hydroxylamine, hydrazines, semicarbazides, thiosemicarbazides, etc.); $\beta'''$ represents a saturated or unsaturated nonaromatic 5-, 6- or 7-membered hydrocarbon ring; and $G^{31}$ represents hydrogen or a halogen atom (e.g., a fluorine atom, a chlorine atom, a bromine atom, etc.).

Specific examples of this type of Y are described in Japanese Patent Application (OPI) Nos. 3819/78 and 48534/79.

Other examples of Y of this type of compound are described in Japanese Patent Publication Nos. 32129/73, 39165/73, Japanese Patent Application (OPI) No. 64436/74, U.S. Pat. No. 3,443,934, etc.

Still further examples of Y are those represented by the following formula (CVII):

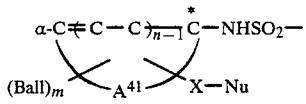

(CVII)

wherein $\alpha$ represents $OR^{41}$ or $NHR^{42}$; $R^{41}$ represents hydrogen or a hydrolyzable component; $R^{42}$ represents hydrogen or an alkyl group containing 1 to 50 carbon atoms; $A^{41}$ represents atoms necessary for forming an aromatic ring; Ball represents an organic immobile group existing on the aromatic ring, with Ball's being the same or different from each other; m represents an integer of 1 or 2; X represents a divalent organic group having 1 to 8 atoms, with the nucleophilic group (Nu) and an electrophilic center (asterisked carbon atom) formed by oxidation forming a 5- to 12-membered ring; Nu represents a nucleophilic group; n represents an integer of 1 or 2; and $\alpha$ may be the same as defined with the above-described formula (CII). Specific examples of this type of Y are described in Japanese Patent Application (OPI) No. 20735/82.

As still further type of examples represented by the formula of (CI), there are dye providing non-diffusible substances which release a diffusible dye in the presence of a base as a result of self cyliczation or the like but which, when reacted with an oxidation product of a developing agent, substantially never release the dye.

Examples of Y effective for this type of compound are those which are represented by the formula (CVIII):

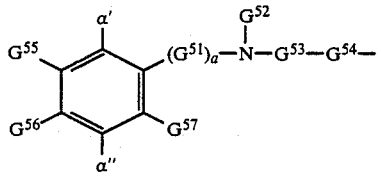

(CVIII)

wherein $\alpha'$ represents an oxidizable nucleophilic group (e.g., a hydroxy group, a primary or secondary amino group, a hydroxyamino group, a sulfonamido group or the like) or a precursor thereof;

$\alpha''$ represents a dialkylamino group or an optional group defined for $\alpha'$;

$G^{51}$ represents an alkylene group having 1 to 3 carbon atoms;

a represents 0 or 1;

$G^{52}$ represents a substituted or unsubstituted alkyl group having 1 to 40 carbon atoms or a substituted or unsubstituted aryl group having 6 to 40 carbon atoms;

$G^{53}$ represents an electrophilic group such as —CO— or —CS—;

$G^{54}$ represents an oxygen atom, a sulfur atom, a selenium atom, a nitrogen atom or the like and, when $G^{54}$ represents a nitrogen atom, it has hydrogen or may be substituted by an alkyl or substituted alkyl group having 1 to 10 carbon atoms or an aromatic residue having 6 to 20 carbon atoms; and $G^{55}$, $G^{56}$ and $G^{57}$ each represents hydrogen, a halogen atom, a carbonyl group, a sulfamyl group, a sulfonamido group, an alkyloxy group having 1 to 40 carbon atoms or an optional group defined for $G^{52}$, $G^{55}$ and $G^{56}$ may form a 5- to 7-membered ring, and $G^{56}$ may represent

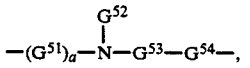

with the proviso that at least one of $G^{52}$, $G^{55}$, $G^{56}$ and $G^{57}$ represents a ballast group. Specific examples of this type of Y are described in Japanese Patent Application (OPI) No. 63618/76.

Further examples of Y suited for this type of compound are those which are represented by the following general formulae (CIX) and (CX):

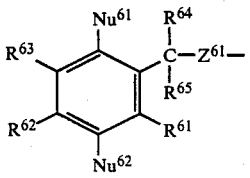

(CIX)

-continued

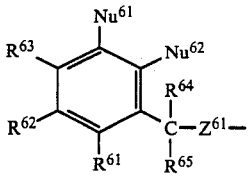

(CX)

wherein $Nu^{61}$ and $Nu^{62}$, which may be the same or different, each represents a nucleophilic group or a precursor thereof; $Z^{61}$ represents a divalent atom group which is electrically negative with respect to the carbon atom substituted by $R^{64}$ and $R^{65}$; $R^{61}$, $R^{62}$ and $R^{63}$ each represents hydrogen, a halogen atom, an alkyl group, an alkoxy group or an acylamino group or, when located at adjacent positions on the ring, $R^{61}$ and $R^{62}$ may form a fused ring together with the rest of the molecule, or $R^{62}$ and $R^{63}$ may form a fused ring together with the rest of the molecule; $R^{64}$ and $R^{65}$, which may be the same or different, each represents hydrogen, a hydrocarbon group or a substituted hydrocarbon group; with at least one of the substituents, $R^{61}$, $R^{62}$, $R^{63}$, $R^{64}$ and $R^{65}$ having a ballast group, Ball, of an enough size so as to render the above-described compounds immobile. Specific examples of this type of Y are described in Japanese Patent Application (OPI) Nos. 69033/78 and 130927/79.

Further examples of Y suited for this type of compound are those which are represented by the formula of (CXI):

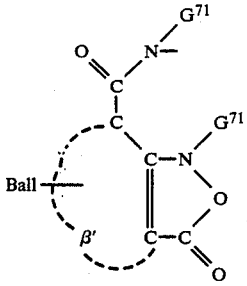

(CXI)

wherein

Ball and $\beta'$ are the same as defined for those in formula (CIII), and $G^{71}$ represents an alkyl group (including a substituted alkyl group). Specific examples of this type of Y are described in Japanese Patent Application (OPI) Nos. 111628/74 and 4819/77.

As different type of compound represented by the general formula (CI), there are illustrated dye providing nondiffusible substances which themselves do not release any dye but, upon reaction with a reducing agent, release a dye. With these compounds, compounds which mediate the redox reaction (called electron donors) are preferably used in combination.

Examples of Y effective for this type of compound are those represented by the formula (CXII):

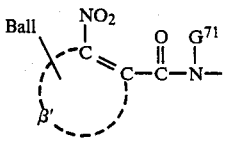

(CXII)

wherein Ball and $\beta'$ are the same as defined for those in the general formula (CIII), and $G^{71}$ represents an alkyl group (including a substituted alkyl group). Specific examples of this type of Y are described in Japanese Patent Application (OPI) Nos. 35533/78 and 110827/78.

Further examples of Y suited for this type of compound are those which are represented by (CXIII):

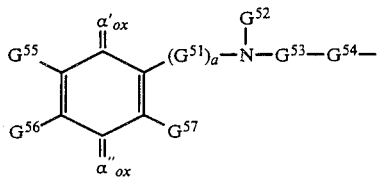

(CXIII)

wherein $\alpha'_{ox}$ and $\alpha''_{ox}$ represent groups capable of giving $\alpha'$ and $\alpha''$, respectively, upon reduction, and $\alpha'$, $\alpha''$, $G^{51}$, $G^{52}$, $G^{53}$, $G^{54}$, $G^{55}$, $G^{56}$, $G^{57}$ and a are the same as defined with respect to formula (CVIII). Specific examples of Y described above are described in Japanese Patent Application (OPI) No. 110827/78, U.S. Pat. Nos. 4,356,249 and 4,358,525.

Further examples of Y suited for this type of compound are those which are represented by the formulae (CXIVA) and (CXIVB):

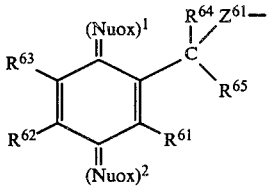

(CXIVA)

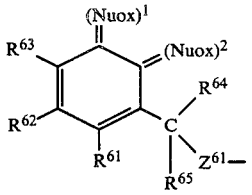

(CXIVB)

wherein $(Nuox)^1$ and $(Nuox)^2$, which may be the same or different, each represents an oxidized nucleophilic group, and other notations are the same as defined with respect to the formulae (CIX) and (CX). Specific examples of this type of Y are described in Japanese Patent Application (OPI) Nos. 130927/79 and 164342/81.

The publicly known documents having been referred to with respect to (CXII), (CXIII), (CXIVA) and (CXIVB) describe electron donors to be used in combination.

As still further different type of compound represented by the general formula (CI), there are illustrated LDA compounds (Linked Donor Acceptor Compounds). These compounds are dye providing non-diffusible substances which cause donor-acceptor reaction in the presence of a base to release a diffusible dye but, upon reaction with an oxidation product of a developing agent, they substantially do not release the dye any more.

Examples of Y effective for this type of compound are those represented by the formula of (CXV) (specific examples thereof being described in Japanese patent application (OPI) No. 60289/83):

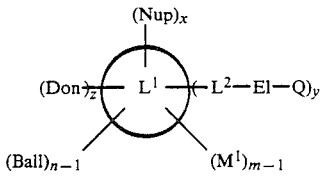

(CXV)

wherein n, x, y and z each represents 1 or 2, m represents an integer of 1 or more; Don represents a group containing an electron donor or its precursor moiety; $L^1$ represents an organic group linking Nup to —El—Q or Don; Nup represents a precursor of a nucleophilic group; El represents an electrophillic center; Q represents a divalent group; Ball represents a ballast group; $L^2$ represents a linking group; and $M^1$ represents an optional substituent.

The ballast group is an organic ballast group which can render the dye providing substance non-diffusible, and is preferably a group containing a $C_{8-32}$ hydrophobic group. Such organic ballast group is bound to the dye providing substance directly or through a linking group (e.g., an imino bond, an ether bond a thioether bond, a carbonamido bond, a sulfonamido bond, a ureido bond, an ester bond, an imido bond, a carbamoyl bond, a sulfamoyl bond, etc., and combination thereof).

In the present invention, the dye-providing substance can be introduced into layers of light-sensitive materials according to known methods as described in, for example, U.S. Pat. No. 2,322,027. In such cases, high boiling organic solvents and low boiling organic solvents as described below may be used.

For example, the dye providing substance is dissolved in a high boiling organic solvent such as an alkyl phthalate (e.g., dibutyl phthalate, dioctyl phthalate, etc.), a phosphate (diphenyl phosphate, triphenyl phosphate, tricresyl phosphate, dioctyl phosphate, etc.), a citric ester (e.g., tributyl acetylcitrate), a benzoic ester (e.g., octyl benzoate), an alkylamide (e.g., diethyllaurylamide), a fatty acid ester (e.g., dibutoxyethyl succinate, dioctyl azelate, etc.), a trimesic ester (e.g., tributyl trimesate), etc., or an organic solvent having a boiling point of from about 30° to about 160° C. such as a lower alkyl acetate (e.g., ethyl acetate, butyl acetate, etc.), ethyl propionate, sec-butyl alcohol, methyl isobutyl ketone, $\beta$-ethoxyethyl acetate, methyl cellosolve acetate, cyclohexanone or the like, then the resulting solution is dispersed in a hydrophilic colloid. The above-described high boiling organic solvents may be used in combination with the low boiling organic solvents.

The methods of dispersing the substance using a polymer described in Japanese Patent Publication No. 39853/76 and Japanese patent application (OPI) No. 59943/76 may also be employed. In dispersing the dye providing substance in a hydrophilic colloid, various surfactants may be used. As such surfactants, those referred to as surfactants in other part of this specification may be used.

In the present invention, the high boiling organic solvent is used in an amount of up to 10 g, preferably up to 5 g, per g of the dye providing substance used.

In the present invention, a reductive substance is desirably incorporated in the light-sensitive material. As such reductive substance, those which are known as reducing agents and the aforementioned reductive dye providing substances are preferable. Examples of the reducing agents to be used in the present invention include the following: hydroquinone compounds (e.g., hydroquinone, 2,5-dichlorohydroquinone, 2-chlorohydroquinone, etc.), aminophenol compounds (e.g., 4-aminophenol, N-methylaminophenol, 3-methyl-4-aminophenol, 3,5-dibromoaminophenol, etc.), catechol compounds (e.g., catechol, 4-cyclohexylcatechol, 3-methoxycatechol, 4-(N-octadecylamino)catechol, etc.), phenylenediamine compounds (e.g., N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.), etc.

More preferable examples of the reducing agents are: 3-pyrazolidone compounds (e.g., 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazoldione, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazoldione, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone and 5-methyl-3-pyrazolidone).

Combinations of various developing agents as described in U.S. Pat. No. 3,039,869 may be used as well.

In the present invention, the reducing agent is added in an amount of 0.01 to 20 mols, particularly preferably 0.1 to 10 mols, per mol of silver.

In the present invention, various dye releasing activators may be used. The dye releasing activators are compounds which are basic and which can activate development or which has so-called nucleophilicity, and bases or base precursors are used.

The dye releasing activator may be used in either of the light-sensitive material and the dye fixing material. In the former case, the use of a base precursor is advantageous. The term "base precursor" as used herein means that which releases a base component upon heating, the base component to be released being an inorganic or organic base.

Preferred examples of the inorganic base include hydroxides, secondary or tertiary phosphates, borates, carbonates, quinolinates, or metaborates of alkali or alkaline earth metals; ammonium hydroxide; quaternary ammonium hydroxide; hydroxides of other metals; etc., and preferred examples of the organic base include aliphatic amines (e.g., trialkylamines, hydroxylamines, aliphatic polyamines, etc.), aromatic amines (e.g., N-alkyl-substituted aromatic amines, N-hydroxyalkyl-substituted aromatic amines, and bis[p-(dialkylamino)-phenyl]methanes), heterocyclic amines, amidines, cyclic amidines, guanidines, and cyclic guanidines. Further, U.S. Pat. No. 2,410,644 describes that betaine tetramethylammonium iodide and diaminobutane dihydrochloride are useful, and U.S. Pat. No. 3,506,444 describes urea and an organic compound having amino acids (e.g., 6-aminocaproic acid). In the present invention, those which have a pKa value of 8 or more are particularly useful.

As the base precursor, those which cause some reaction upon heating to release bases, such as salts between organic acids and bases which undergo decarbonization upon heating to decompose, and those compounds which are decomposed according to Lossen rearrangement, Beckmann rearrangement or the like to release amine, are used.

Preferable examples of the base precursors include precursors of the aforementioned organic bases. For example, there are illustrated salts with heat decomposable organic acids (e.g., trichloroacetic acid, trifluoroacetic acid, propiolic acid, cyanoacetic acid, sulfonylacetic acid, acetoacetic acid, etc.), and salts with 2-carboxycarboxamide described in U.S. Pat. No. 4,088,496.

Specific examples of the base precursors are illustrated below. As compounds which are considered to undergo decarbonization of the acid moiety to release a base, there are the following compounds.

As trichloroacetic acid derivatives, there are illustrated guanidinetrichloroacetic acid, piperidinetrichloroacetic acid, morpholinetrichloroacetic acid, p-toluidinetrichloroacetic acid, 2-picolinetrichloroacetic acid, etc.

In addition, base precursors described in British Pat. No. 998,945, U.S. Pat. No. 3,220,846, Japanese Patent Application (OPI) No. 22625/75, etc., can be used.

As other examples than the trichloroacetic acid derivatives, there are illustrated salts between bases and 2-carboxycarboxamide derivatives described in U.S. Pat. No. 4,088,496, α-sulfonylacetate derivatives described in U.S. Pat. No. 4,060,420, and propiolic acid derivatives described in Japanese Patent Application No. 55700/83. As the base component, salts with alkali metals or alkaline earth metals are also useful as well as salts with the organic bases, and examples thereof are described in Japanese Patent Application No. 69597/83.

As other precursors, hydroxamcarbamates described in Japanese Patent Application No. 43860/83 (corresponding to European Pat. No. 120,661) utilizing Lossen rearrangement, aldoximecarbamates described in Japanese Patent Application (OPI) No. 31614/83 producing nitrile, etc., are effective.

Further, amineimides described in *Research Disclosure,* 15776 (May, 1977) and aldoneamides described in Japanese Patent Application (OPI) No. 22625/75 are decomposed at elevated temperatures to produce base, thus being preferably usable.

These bases or base precursors may be used in a wide range of amounts, usefully in amounts of up to 50 wt%, more preferably 0.01 wt% to 40 wt%, based on the weight of dry coat of a light-sensitive material.

The above-described bases or base precursors may, or course, be used for other purposes (for example, adjustment of pH value) as well as for acceleration of releasing the dye.

Binders to be used in the present invention may be used alone or in combination. Hydrophilic binders may be used. Typical examples of the hydrophilic binder are transparent or semitransparent hydrophilic binders and include natural substances such as proteins (e.g., gelatin and gelatin derivatives), cellulose derivatives, and polysaccharides (e.g., starch, gum arabic, etc.) and synthetic polymers such as water-soluble polyvinyl compounds (e.g., polyvinylpyrrolidone, acrylamide polymer, etc.). As other synthetic polymer substances, there are dispersed vinyl compounds in a latex form which serve to increase dimensional stability of photographic materials.

In the present invention, those compounds which activate development and stabilize the resulting image may be used. Of such compounds, compounds having a 2-carboxycarboxamido group as an acid moiety, such as isothiuronium compounds represented by 2-hydroxyethylisothiuronium.trichloroacetate described in U.S. Pat. No. 3,301,678; bisisothiuroniums such as 1,8-(3,6-dioxaoctane)bis(isothiuronium trichloroacetate) described in U.S. Pat. No. 3,669,670; thiol compounds described in German Patent (OLS) No. 2,162,714; thiazolium compounds such as 2-amino-2-thiazolium.-trichloroacetate and 2-amino-5-bromoethyl-2-thiazolium.trichloroacetate described in U.S. Pat. No. 4,012,260; and bis(2-amino-2-thiazolium)methylenebis(-sulfonylacetate), 2-amino-2-thiazoliumphenylsulfonyl acetate, etc., described in U.S. Pat. No. 4,060,420; and the like are preferably used.

Further, azolthioethers and blocked azolinethione compounds described in Belgian Pat. No. 768,071, 4-aryl-1-carbamyl-2-tetrazolin-5-thione compounds described in U.S. Pat. No. 3,893,859, and compounds described in U.S. Pat. Nos. 3,839,041, 3,844,788 and 3,877,940 are also preferably used.

In the present invention, image toning agents may be incorporated, if necessary. Effective toning agents include 1,2,4-triazoles, 1H-tetrazoles, thiouracils, 1,3,4-thiadiazoles, etc. Preferable examples thereof include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, etc. Particularly effective toning agents are those which can form black image.

The concentration of the toning agent to be incorporated varies depending upon the kind of heat developable light-sensitive material, processing conditions, desired image, etc., but, in general, it ranges from about 0.001 to about 0.1 mol per mol of silver in the light-sensitive material.

In the present invention, the above-described components constituting the heat developable light-sensitive material can be provided at any suitable position. For example, one or more components may be provided in one or more coatings of a light-sensitive material. In some cases, specific portions of the aforesaid reducing agent, image stabilizer and/or other additives are desirably incorporated in a protective layer. Such incorporation can reduce transference of the additives from layer to layer of the heat developable light-sensitive material, thus being in some cases advantageous.

The heat developable light-sensitive material of the present invention is effective for forming a negative or positive image. Formation of a negative image or positive image mainly depends upon selection of a specific light-sensitive silver halide. For example, in order to form direct positive images, there may be used internal latent image silver halide emulsions described in U.S. Pat. Nos. 2,592,250, 3,206,313, 3,367,778, 3,447,927, etc., and a mixture of a surface latent image silver halide emulsion and an internal latent image silver halide emulsion as described in U.S. Pat. No. 2,996,382.

In the present invention, various exposing means may be employed. Latent images may be obtained by imagewise exposure with radiation including visible light. In general, those usually used as light source, such as sunlight, strobo, flash, tungsten lamp, mercury lamp, halogen lamp (e.g., iodine lamp), xenon lamp, laser light, CRT light source, plasma light source, fluorescent lamp, light-emitting diode, etc., may be used.

In the present invention, development is effected by heating a light-sensitive material. Heating means may be a mere hot plate, iron, hot roller, heater element utilizing carbon or titanium white, or the analogous material thereof.

Supports to be used in the light-sensitive material of the present invention and, in some cases, in dye fixing materials must withstand the processing temperature. As general supports, acetylcellulose film, cellulose ester film, polyvinyl acetal film, polystyrene film, polycarbonate film, polyethylene terephthalate film, and related films or resin materials are used as well as glass, paper, metal and their analogs. Paper supports laminated with a polymer such as polyethylene may also be used. Polyesters described in U.S. Pat. Nos. 3,634,089 and 3,725,070 are preferably used.

The photographic light-sensitive material of the present invention and the dye fixing material may contain, in the photographic emulsion layer or other binder layer thereof, organic or inorganic hardeners. For example, chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g, 1,3,5-triacryloylhexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.) can be used alone or in combination.

In the case of using a dye providing substance which imagewise releases a mobile dye, a dye transfer assistant may be used for aiding transference of the dye from the light-sensitive layer to the dye fixing layer.

In the manner of providing the transfer assistant from outside, water or a basic aqueous solution containing sodium hydroxide, potassium hydroxide, an inorganic alkali metal salt or the like is used as the dye transfer assistant. Further, low boiling solvents such as methanol, N,N-dimethylformamide, acetone, diisobutylketone, or a mixture of these solvents and water or a basic aqueous solution may be used. The dye transfer assistant may be used in a manner of wetting an image receiving layer with it.

Incorporation of the transfer assistant in the light-sensitive material or dye fixing material eliminates the necessity of providing the transfer assistant from outside. The above-described transfer assistant may be incorporated in the material in the form of crystal water or microcapsules, or may be incorporated as a precursor capable of releasing a solvent at elevated temperatures. A more preferable manner is to incorporate in the light-sensitive material or dye fixing material a hydrophilic thermal solvent which is solid at ordinary temperatures and melts at elevated temperatures. The hydrophilic thermal solvent may be incorporated either in the light-sensitive material or in the dye fixing material, or in both of them. It may be incorporated in any of an emulsion layer, an inter layer, a protective layer, and a dye fixing layer, with the dye fixing layer and/or its adjacent layer being preferable.

Examples of the hydrophilic thermal solvent include ureas, pyridines, amides, sulfonamides, imides, alcohols, oximes, and other heterocyclic compounds.

As other compounds to be used in the light-sensitive material of the present invention such as sulfamide derivatives, cationic compounds having pyridinium group or the like, surfactants having polyethylene oxide chain, antihalation and anti-irradiation dyes, hardeners, mordants, etc., those described in European Pat. Nos.

76,492 and 66,282, West German Pat. No. 3,315,485, Japanese Patent Application Nos. 28928/83 and 26008/83 (corresponding to European Pat. No. 119,470) may be used. Exposure may also be effected according to the above-cited patents.

The present invention is not illustrated in greater detail by reference to the following examples which, however, are not to be construed as limiting the present invention in any way.

EXAMPLE 1

Silver chlorobromide emulsion (A) was prepared as follows.

24 g of gelatin, 5.6 g of sodium chloride, and 0.6 g of potassium bromide were dissolved in 1 liter of water (solution I). This solution was stirred while maintaining the temperature at 50° C. Then, a solution of 100 g of sodium nitrate in 300 ml of water (solution a) and a solution of 40 g of sodium chloride and 20 g of potassium bromide in 300 ml of water (solution b) were simultaneously added to the solution I for 90 minutes.

The pH of the resulting silver chlorobromide emulsion was adjusted to flocculate and, after removal of excess salts, 70 g of water and 12 g of gelatin were added thereto to adjust the pH of the emulsion to 6.0. After gold sensitization and sulfur sensitization, there was obtained 400 g of silver chlorobromide emulsion (A).

Silver chlorobromide emulsion (B) was prepared as follows.

400 g of silver chlorobromide emulsion (B) was prepared in absolutely the same manner as with silver chlorobromide emulsion (A) except for adding solution a and solution b used for preparing silver chlorobromide emulsion (A) and a solution of 0.02 g of dye I in 300 ml of methanol (solution c) simultaneously to the solution I for 90 minutes.

Dye I:

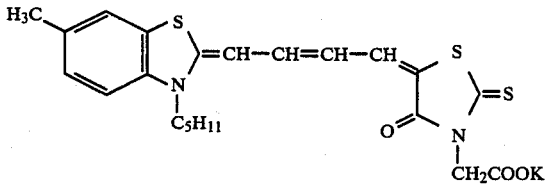

A dispersion of a dye-providing substance in gelatin was prepared as follows.

5 g of cyan dye providing substance (21) described in Example 3, 0.5 g of sodium 2-ethylhexyl sulfosuccinate, and 5 g of tricresyl phosphate (TCP) were weighed, and 30 ml of ethyl acetate was added thereto. The resulting mixture was heated to about 60° C. to obtain a uniform solution. This solution was mixed with 100 g of a 10 wt% solution of lime-processed gelatin under stirring, followed by dispersing for 10 minutes in a homogenizer at 10,000 rpm.

This dispersion is referred to as a dispersion of dye providing substance (21).

A gelatin dispersion was prepared in absolutely the same manner as with the dispersion of dye providing substance (21) except for not incorporating the cyan dye providing substance.

Light-Sensitive Material A was prepared as follows.

| Light-Sensitive Material A | | |
|---|---|---|
| (a) | Silver chlorobromide emulsion (B) described above | 25 g |
| (b) | Dispersion of dye-providing substance (21) | 33 g |
| (c) | 5 wt % Aqueous solution of Compound AA as shown below: | 5 ml |

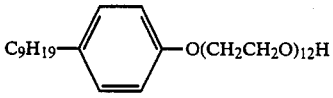

| | | |
|---|---|---|
| (d) | 10 wt % Aqueous solution of the following compound: $H_2N—SO_2N(CH_3)_2$ | 4 ml |
| (e) | Water | 12 ml |

The above-described components (a) to (e) were mixed and dissolved, then coated in a wet thickness of 30 μm on a polyethylene terephthalate film and dried. Further, a solution prepared by mixing the following three components was coated in a wet thickness of 25 μm as a protective layer and dried to prepare Light-Sensitive Material A.

| | | |
|---|---|---|
| (f) | 10 wt % Aqueous solution of lime-processed gelatin | 35 g |
| (g) | Sodium 2-ethylhexyl sulfosuccinate 1 wt % aq. soln. | 4 ml |
| (h) | Water | 55 ml |

Light-Sensitive Material B was prepared as follows.

| | | |
|---|---|---|
| (a) | Silver chlorobromide emulsion (A) described above | 25 g |
| (b) | Solution c described above | 18.75 ml |
| (c) | Dispersion of dye providing substance (21) | 33 g |
| (d) | 5 wt % Aqueous solution of Compound AA as shown below: | 5 ml |

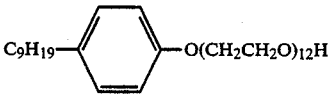

| | | |
|---|---|---|
| (e) | 10 wt % Aqueous solution of the following compound: $H_2N—SO_2—N(CH_3)_2$ | 4 ml |
| (f) | Water | 12 ml |

As a protective layer, the same one as with Light-Sensitive Material A was used.

Light-Sensitive Material C was prepared in absolutely the same manner as Light-Sensitive Material B except for using the aforesaid gelatin dispersion in place of the dispersion of dye providing substance (21).

Light-Sensitive Materials A to C were exposed to red light through a wedge, processed with the following developer, and then fixed.

The same exposing and development processing were effected using Light-Sensitive Materials A to C having been stored at 40° C. for 1 day.

| Developer (20° C.): | |
|---|---|
| Metol | 5 g |
| L-Ascorbic acid | 20 g |

-continued

| Developer (20° C.): | |
|---|---|
| Potassium bromide | 2 g |
| Sodium metaborate ($NaBO_2.4H_2O$) | 70 g |

After adjusting pH to 9.57, water was added thereto to make the total volume 2 liters.

Stopping Solution:

1 wt% Acetic acid aqueous solution

Fixing Solution:

A solution prepared by using "Fuji Fix" (made by Fuji Photo Film Co., Ltd.) as indicated.

The silver images thus obtained were subjected to measurement of sensitivity to obtain the following results.

| | Reduction in Sensitivity after Standing 1 Day at 40° C. (in log) |
|---|---|
| A (Present Invention) | −0.02 |
| B (for Comparison) | −0.52 |
| C (for Comparison) | −0.01 |

It is seen from the above results that incorporation of a dye providing substance having a dye moiety in a red-sensitive emulsion layer having been color sensitizing in a conventional manner lead to reduction in sensitivity of the light-sensitive material during storage (form the comparison of Light-Sensitive Material B with Light-Sensitive Material C) and that Light-Sensitive Material A in accordance with the present invention suffered less desensitization.

EXAMPLE 2

An emulsion of silver salt of 5-chlorobenzotriazole was prepared as follows.

28 g of gelatin and 16.8 g of 5-chlorobenzotriazole were dissolved in a mixture of 1,000 ml of water and 2,000 ml of ethanol. This solution was kept at 40° C. and stirred. A solution of 17 g of silver nitrate in 100 ml of water was added thereto for 2 minutes.

The pH of the emulsion of the silver salt of 5-chlorobenzotriazole was adjusted to flocculate, followed by removing excess salts. Then, the pH was adjusted to 6.0 to obtain 400 g of an emulsion of the silver salt of 5-chlorobenzotriazole.

Light-Sensitive Material D was prepared as follows.

| | | |
|---|---|---|
| (a) | Emulsion (B) of Example 1 | 5 g |
| (b) | Emulsion of silver salt of 5-chlorobenzotriazole | 10 g |
| (c) | Dispersion of dye providing substance (21) of Example 1 | 33 g |
| (d) | 5 wt % Aqueous solution of Compound AA as shown below: 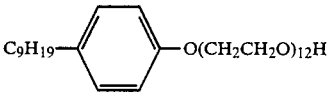 | 5 ml |
| (e) | 10 wt % Ethanol solution of guanidine trichloroacetate | 12 ml |
| (f) | 10 wt % Aqueous solution of the following compound: $H_2N—SO_2—N(CH_3)_2$ | 4 ml |

After mixing and dissolving (a) to (f) described above, the resulting solution was coated in a wet thickness of 30 μm on a polyethylene terephthalate film and dried. Further, a solution prepared by mixing the following four components was coated thereon in a wet thickness of 25 μm as a protective layer, then dried to prepare Light-Sensitive Material D.

| | | |
|---|---|---|
| (g) | 10 wt % Aqueous solution of lime-processed gelatin | 35 g |
| (h) | 10 wt % Ethanol solution of guanidine trichloroacetate | 6 ml |
| (i) | 1 wt % Aqueous solution of sodium 2-ethylhexyl sulfosuccinate | 4 ml |
| (j) | Water | 55 ml |

Light-Sensitive Material E was prepared as

| | | |
|---|---|---|
| (a) | Emulsion (A) of Example 1 | 5 g |
| (b) | Emulsion of silver salt of 5-chlorobenzotriazole | 10 g |
| (c) | Solution c of Example 1 | 3.75 ml |
| (d) | Dispersion of dye providing substance (21) of Example 1 | 33 g |
| (e) | 5 wt % Aqueous solution of Compound AA as shown below: 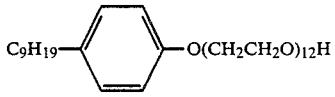 | 5 ml |
| (f) | 10 wt % Ethanol solution of guanidine trichloroacetate | 12 ml |
| (g) | 10 wt % Aqueous solution of the following compound: $H_2N—SO_2—N(CH_3)_2$ | 4 ml |

The above-described components (a) to (g) were mixed, and the resulting solution was coated in a wet thickness of 30 μm on a polyethylene terephthalate film and dried. Subsequent procedures were conducted in the same manner as Light-Sensitive Material D.

Then, Light-Sensitive Materials D and E, both fresh ones immediately after coating and ones having been left for 1 day at 40° C., were exposed, then uniformly heated on a 150° C. heat block for 30 seconds.

A dye fixing material was prepared as follows.

10 g of poly(methyl acrylate-co-N,N,N-trimethyl-N-vinylbenzylammonium chloride) (the weight ratio of methyl acrylate to vinylbenzylammonium chloride being 1:1) was dissolved in 200 ml of water, and uniformly mixed with 100 g of 10 wt% lime-processed gelatin. This solution was uniformly coated in a wet thickness of 90 μm on a paper support laminated with polyethylene containing dispersed therein titanium dioxide. After drying, the sample was used as a dye fixing material having a mordanting layer.

After dipping this dye fixing material into water, the above-described light-sensitive materials having been heated were superposed thereon with the coated surface in contact with each other. The resulting assemblies were heated for 6 seconds on a 80° C. heat block. Upon peeling the dye fixing material from the light-sensitive material, negative cyan images were obtained on the dye fixing material. The sensitivity of each of the negative images to red light was measured using a Macbeth reflective densitometer (RD-519). The results thus obtained are shown in the following table.

| | Reduction in Sensitivity after 1 Day Standing at 40° C. (in log) |
|---|---|
| D (Present Invention) | −0.01 |
| E (for Comparison) | −0.49 |

Light-Sensitive Material D based on the present invention was demonstrated to undergo less reduction in sensitivity of color image than Light-Sensitive Material E.

EXAMPLE 3

First, silver iodobromide emulsion (C) was prepared as follows.

24 g of gelatin, 1 g of potassium bromide, and 10 ml of 25 wt% ammonia were dissolved in 1 liter of water (solution II). This solution was kept at 50° C. and stirred. Then, a solution of 100 g of silver nitrate in 1 liter of water (solution d) and a solution of 63 g of potassium bromide and 12 g of potassium iodide in 1 liter of water (solution e) were simultaneously added to solution II for 50 minutes.

Desalting and post ripening of the emulsion were conducted in the same manner as with the silver chlorobromide emulsion prepared in Example 1 to obtain 400 g of silver iodobromide emulsion (C).

400 g of silver iodobromide emulsion (D) was prepared in the same manner as with silver iodobromide emulsion (C) except for adding solution f of 0.02 g of dye II in 300 ml of methanol together with solution d and solution e.

Dye II:

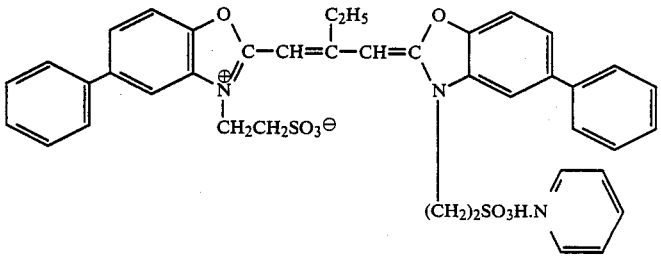

Dispersions of dye providing substances (22) and (23) were prepared in the same manner as with the gelatin dispersion of cyan dye-providing substance (21) used in Example 1 except for using 5 g of dye providing substance (22) and 5 g of dye providing substance (23), respectively, in place of dye providing substance (21).

Dye providing substances used are shown below.

(21)

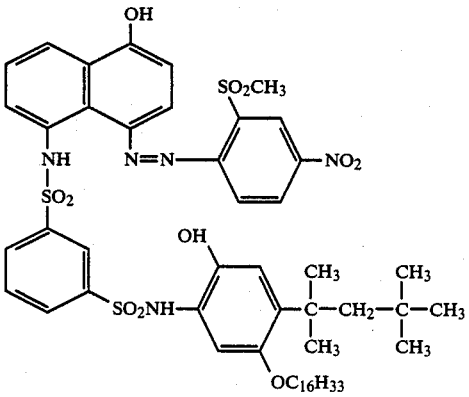

(22)

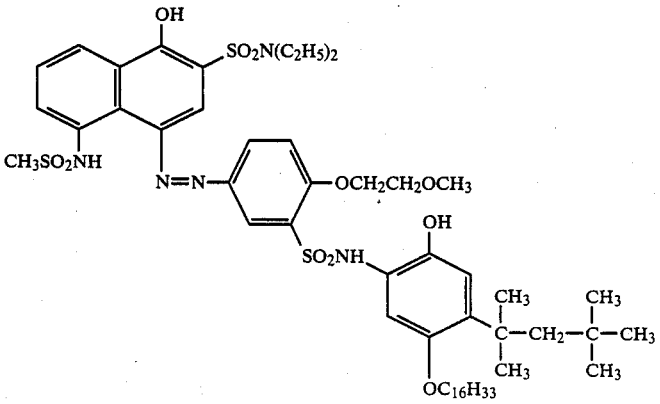

-continued (23)

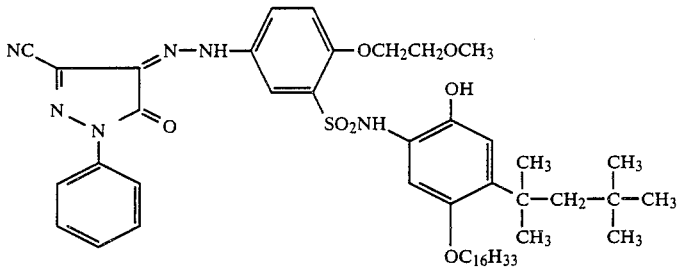

The formulation of a coating solution for forming a blue-sensitive layer is shown below.

| | |
|---|---|
| Silver iodobromide emulsion (C) | 5 g |
| Emulsion of silver salt of benzotriazole | 10 g |
| Dispersion of dye providing substance (23) | 33 g |
| 5 wt % Aqueous solution of the following compound: | 24 ml |

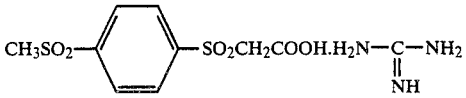

| | |
|---|---|
| 5 wt % Aqueous solution of the following compound: | 5 ml |

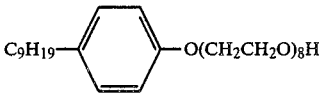

| | |
|---|---|
| 10 wt % aqueous solution of dimethylsulfamide | 4 ml |
| water | 5 ml |

A coating solution for forming a green-sensitive layer was prepared as follows.

| | |
|---|---|
| Silver iodobromide emulsion (D) | 5 g |
| Emulsion of silver salt of benzotriazole | 10 g |
| Dispersion of dye providing substance (22) | 33 g |
| 5 wt % Aqueous solution of the following compound: | 24 ml |

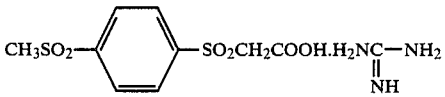

| | |
|---|---|
| 5 wt % Aqueous solution of the following compound: | 5 ml |

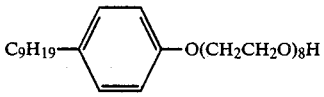

| | |
|---|---|
| 10 wt % Aqueous solution of dimethylsulfamide | 4 ml |
| Water | 5 ml |

A coating solution for forming a red-sensitive layer was prepared in absolutely the same manner as the coating solution for forming a green-sensitive layer except for using silver chlorobromide emulsion (B) of Example 1 in place of silver iodobromide emulsion (D) and using a gelatin dispersion of cyan dye providing substance (21) used in Example 1.

The thus prepared coating solutions were coated on a support in the order of red-sensitive layer, interlayer, green-sensitive layer, interlayer, blue-sensitive layer, and protective layer each in an amount of 400 mg/m$^2$ of silver.

The interlayer and the protective layer were coated in amounts of 1,000 mg of gelatin/m$^2$ and 190 mg/m$^2$ of

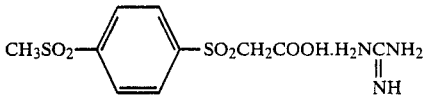

respectively.

This sample was exposed to white light through a wedge immediately after application of the coating solutions or after leaving for 3 days at 50° C., then heated and subjected to image transferring process in the same manner as in Example 2. The sensitivity with each color of the resulting image was measured to obtain the results tabulated below.

| | Reduction in Sensitivity after 3 Day Standing at 50° C. (in log) |
|---|---|
| Blue-Sensitive Layer | ±0 |
| Green-Sensitive Layer | −0.01 |
| Red-Sensitive Layer | −0.02 |

It is seen from the above-described results that the heat developable multicolor light-sensitive material in accordance with the present invention possesses improved preservability.

The aforesaid emulsion of silver salt of benzotriazole was prepared as follows.

28 g of gelatin and 13.2 g of benzotriazole were dissolved in 3,000 ml of water. This solution was kept at 40° C. and stirred. A solution of 17 g of silver nitrate in 100 ml of water was added to this solution for 2 minutes.

The pH of the benzotriazole silver salt emulsion was adjusted to flocculate and remove excess salts. Then, the pH was adjusted to 6.0 to obtain 400 g of a benzotriazole silver salt emulsion.

EXAMPLE 4

10 g of dye providing substance (24) having the following structure, 0.5 g of sodium 2-ethylhexyl sulfosuccinate, and 10 g of triecrsyl phosphate were weighed, and 20 ml of cyclohexanone was added thereto, followed by heating to 60° C. to obtain a uniform solution. This solution was mixed with 100 g of a 10 wt% aqueous solution of lime-processed gelatin under stirring, then emulsified and dispersed in a homogenizer. Dye Providing Substance (24)

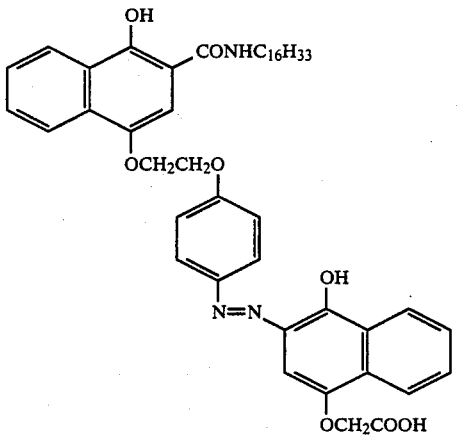

Emulsion (E) was prepared as follows.

40 g of gelatin and 26 g of potassium bromide were dissolved in 3,000 ml of water. This solution was kept at 50° C. and stirred. Then, a solution of 34 g of silver nitrate in 200 ml of water was added thereto for 10 minutes, followed by adding thereto for 2 minutes a solution of 3.3 g of potassium iodide in 100 ml of water.

The pH of the thus prepared silver iodobromide emulsion was adjusted to flocculate and remove excess salts.

Then, the pH was adjusted to 6.0, and the emulsion was subjected to sulfur sensitization and gold sensitization in the conventional manner to obtain 400 g of a silver iodobromide emulsion.

Emulsion (F) was prepared as follows.

40 g of gelatin and 26 g of potassium bromide were dissolved in 3,000 ml of water. This solution was kept at 50° C. and stirred. Then, a solution of 34 g of silver nitrate in 200 ml of water and 200 ml of a solution prepared by dissolving 0.02 g of dye II used in Example 3 in 300 ml of methanol were simultaneously added to the above-described KBr-containing solution for 10 minutes.

Thereafter, a solution of 3.3 g of KI in 100 ml of water was added thereto in 2 minutes. Subsequent procedures were conducted in absolutely the same manner as emulsion A to obtain 400 g of a silver iodobromide emulsion.

Light-Sensitive Material 401 was prepared as follows.

| | | |
|---|---|---|
| (a) | Silver iodobromide emulsion (F) | 5.5 g |
| (b) | 10 wt % Gelatin aqueous solution | 2 g |
| (c) | Dispersion of the above-described dye providing substance | 2.5 g |
| (d) | 10 wt % Ethanol solution of guanidine trichloroacetate | 0.5 ml |
| (e) | 10 wt % Methanol solution of 2,6-dichloro-4-aminophenol | 0.5 ml |
| (f) | 5 wt % Aqueous solution of the following compound | 1 ml |

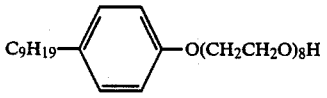

| | | |
|---|---|---|
| (g) | Water | 6 ml |

After mixing and heating the above-described components (a) to (g), the resulting solution was coated in a wet thickness of 85 μm. Gelatin was coated thereon as a protective layer in an amount of 1.5 g/m² to prepare Light-Sensitive Material 401.

Light-Sensitive Material 402 was prepared as follows.

| | | |
|---|---|---|
| (h) | Silver iodobromide emulsion (F) | 5.5 g |
| (i) | Solution (5) prepared by dissolving 0.02 g of dye II used in Example 3 in 300 ml of methanol | 4.125 ml |

(h) and (i) were mixed with components (c) to (g) of Light-Sensitive Material 401, and subsequent procedures were conducted in the same manner as with Light-Sensitive Material 401 to prepare Light-Sensitive Material 402.

Light-Sensitive Materials 401 and 402, both fresh ones immediately after coating and ones having been left for 1 day at 40° C., were exposed to green light through a wedge, then subjected to the same heating and image transferring procedures as in Example 2 using the dye fixing material used in Example 1. Reduction in sensitivity after leaving at 40° C. for 1 day was determined in log.

| Light-Sensitive Material | Sensitivity Reduction after 1 Day Standing at 40° C. (in log) |
|---|---|
| 401 | −0.03 |
| 402 | −0.47 |

It is seen that the present invention is effective with the dye providing substance which reacts with an oxidation product of a reducing agent to release a dye.

EXAMPLE 5

To a mixture of 5 g of dye providing substance (25) having the following structure, 4 g of an electron donor having the following structure, 0.5 g of sodium 2-ethylhexyl sulfosuccinate, and 10 g of tricresyl phosphate was added 20 ml of cyclohexanone, then heated to about 60° C. to dissolve. Subsequent procedures were conducted in the same manner as in Example 4 to prepare a dispersion of a reducible dye providing substance.

Dye Providing Substance (25):

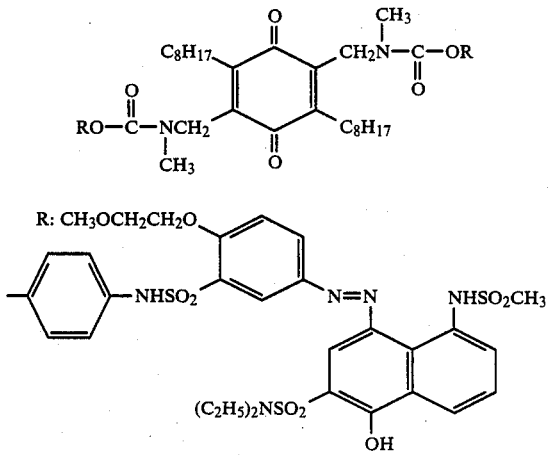

Electron Donor:

-continued

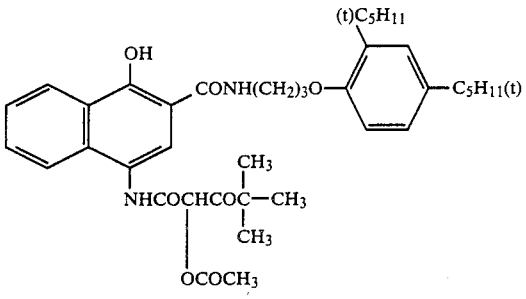

Light-Sensitive Material 501 was prepared as follows.

| | | |
|---|---|---|
| (a) | Silver iodobromide emulsion (F) of Example 4 | 5 g |
| (b) | Dispersion of dye providing substance (25) | 3.5 g |
| (c) | Solution prepared by dissolving 220 mg of guanidine trichloroacetate in 2 ml of ethanol | The Whole |
| (d) | 5 wt % Aqueous solution of the following compound: 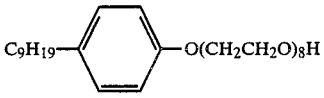 | 1.5 ml |

2 ml of water was added to a mixture of the above-described components, mixed, and heated to dissolve, followed by coating in a wet thickness of 60 μm on a polyethylene terephthalate film.

Light-Sensitive Material 502 was prepared as follows.

| | | |
|---|---|---|
| (e) | Silver iodobromide emulsion (E) used in Example 4 | 5 g |
| (f) | Solution of 0.02 g of Dye II used in Example 3 in 300 ml of methanol | 3.75 ml |

The above-described (e) and (f) were mixed with (b) to (d) of Light-Sensitive Material 501, and subsequent procedures were conducted in the same manner as Light-Sensitive Material 501 to prepare Light-Sensitive Material 502.

Light-Sensitive Materials 501 and 502, both fresh ones immediately after coating and ones having been left at 40° C. for 1 day, were exposed to green light through a wedge, then uniformly heated for 30 seconds on a 130° C. heat block. Image transfer was conducted in the same manner as Example 1 using the dye fixing material of Example 1, and the sensitivity of each sample was measured to obtain the following results.

| Light-Sensitive Material | Sensitivity Reduction after 1 Day Standing at 40° C. (in log) |
|---|---|
| 501 | −0.01 |
| 502 | −0.50 |

The effects of the present invention are apparent.

EXAMPLE 6

Emulsions 601 to 606 were prepared in the same manner as silver chlorobromide emulsion (B) of Example 1 except for using the following dyes III to XVIII in place of dye I.

Then Light-Sensitive Materials 601 to 616 were prepared in the same manner as Light-Sensitive Material D except for using emulsions 601 to 616, respectively, in place of emulsion B of Example 2.

Light-Sensitive Materials 601 to 616, both fresh ones immediately after coating and ones having been left for 1 day at 40° C., were exposed, then uniformly heated for 30 seconds on a 150° C. heat block.

The thus heated light-sensitive materials were subjected to the same processings as in Example 2 to measure sensitivity reduction of the samples having been left at 40° C. for 1 day. The reduction was found to be at most 0.02 in log, thus good preservability of the light-sensitive materials of the present invention was demonstrated.

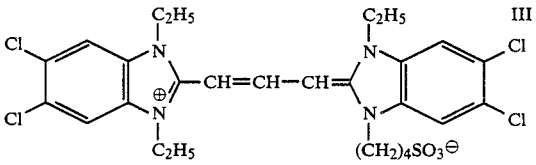

III

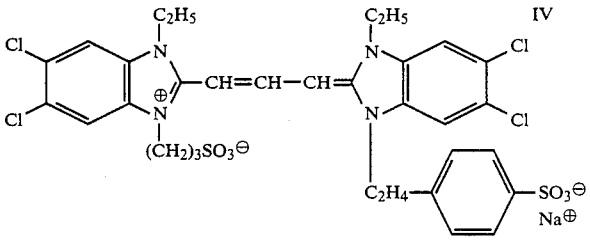

IV

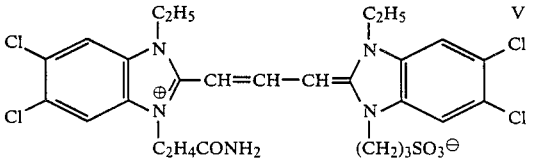

V

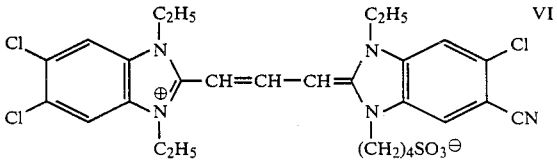

VI

-continued
VII
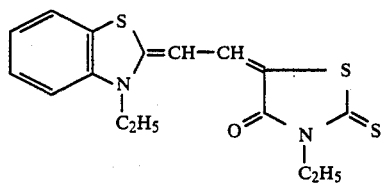
VIII
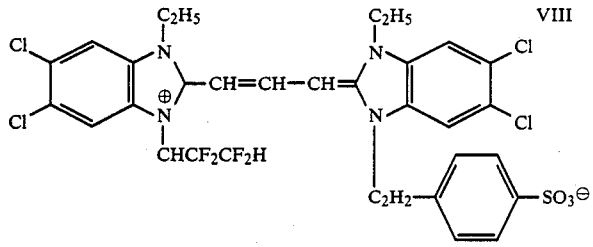
IX
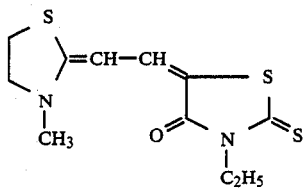
X
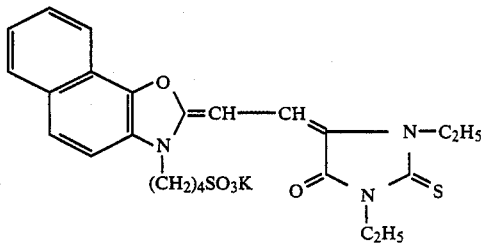
XI
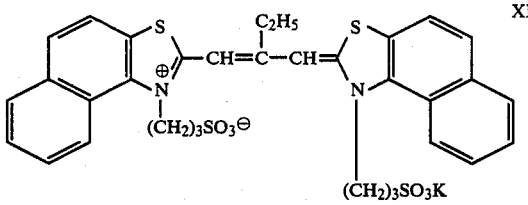
XII
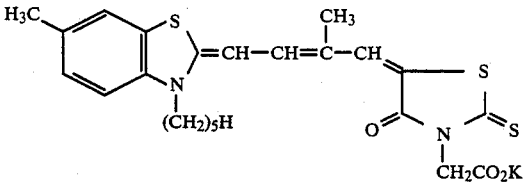
XIII
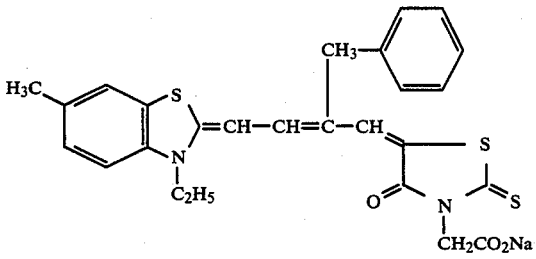
XIV
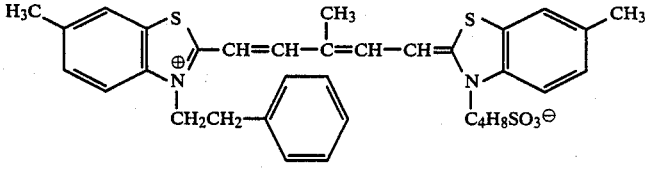
XV
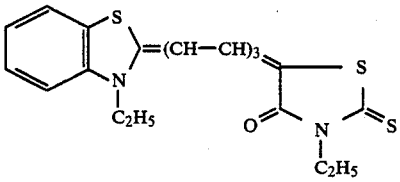
XVI
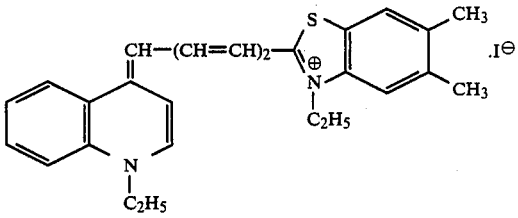
XVII
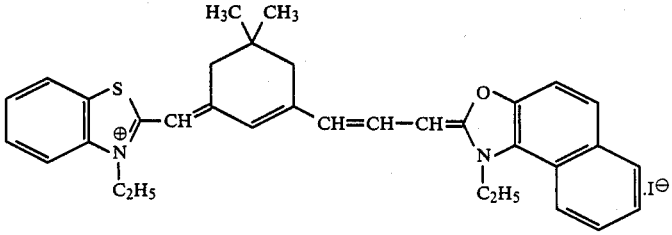

-continued

XVIII

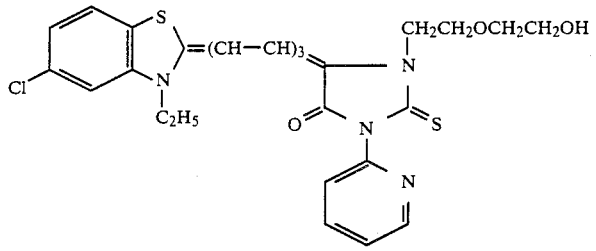

While the invention has been described in detail and with reference to specific embodiments thereof, it will be apparent to one skilled in the art that various changes and modifications can be made therein without departing from the spirit and scope thereof.

What is claimed is:

1. A heat developable color light-sensitive material, comprising a support having provided thereon at least a light-sensitive silver halide emulsion, a hydrophilic binder, and a compound having a dye moiety within the molecule and which is capable of releasing, upon reduction of light-sensitive silver halide to silver at elevated temperatures, said dye moiety corresponding to or inversely corresponding to the reduction to form a dye different from said compound in terms of diffusibility, wherein said light-sensitive silver halide emulsion is prepared by forming silver halide grains in the presence of a spectral sensitizing dye.

2. The heat developable color light-sensitive material as claimed in claim 1, wherein said sensitizing dye is employed in an amount of 0.001 g to 20 g per 100 g of silver.

3. The heat developable color light-sensitive material as claimed in claim 2, wherein said sensitizing dye is employed in an amount of 0.1 g to 2 g per 100 g of silver.

4. The heat developable color light-sensitive material as claimed in claim 1, wherein the amount of light-sensitive silver halide is coated in a silver amount of 1 mg to 100 g/m$^2$.

5. The heat developable color light-sensitive material as claimed in claim 4, wherein the amount of light-sensitive silver halide is coated in a silver amount of 10 mg to 50 g/m$^2$.

6. The heat developable color light-sensitive material as claimed in claim 1, wherein said binder is a hydrophilic binder selected from the group consisting of proteins, cellulose derivatives, polysaccharides and synthetic polymers.

7. The heat developable color light-sensitive material as claimed in claim 1, wherein said compound having a dye moiety within the molecule is represented by the following general formula (CI):

$$(\text{Dye—X})_q\text{—Y} \qquad \text{(CI)}$$

wherein Dye represents a dye moiety which, when released from the molecule, has a diffusibility different from that of $(\text{Dye—X})_q$—Y, q represents 1 or 2 and when q=2, Dye—X may be the same or different from each other, X represents a bond or linking group and Y represents a group which releases Dye in direct or inverse conformity with light-sensitive silver salt having an imagewise latent image to cause a difference in diffusibility between the released dye and the compound represented by $(\text{Dye—X})_q$—Y.

8. The heat developable color light-sensitive material as claimed in claim 1, wherein the sensitizing dye is present in at least one process selected from a process of formation of a dispersion of grains of silver halide and a process of physical ripening of silver halide grains.

9. The heat developable color light-sensitive material as claimed in claim 1, wherein the sensitizing dye is present in the process of formation of a dispersion of grains of silver halide.

10. The heat developable color light-sensitive material as claimed in claim 1, wherein the sensitizing dye is present in the process of physical ripening of silver halide grains.

* * * * *